US011380164B2

(12) United States Patent
Hughes et al.

(10) Patent No.: US 11,380,164 B2
(45) Date of Patent: Jul. 5, 2022

(54) GAMING SYSTEM AND METHOD FOR PROVIDING RANDOMLY DETERMINED PROGRESSIVE AWARD RESET VALUES

(71) Applicant: IGT, Las Vegas, NV (US)

(72) Inventors: William Keith Hughes, Reno, NV (US); Timothy Kennedy, Reno, NV (US); Robin S. Heenan, Reno, NV (US)

(73) Assignee: IGT, Las Vegas, NV (US)

( * ) Notice: Subject to any disclaimer, the term of this patent is extended or adjusted under 35 U.S.C. 154(b) by 6 days.

(21) Appl. No.: 16/917,117

(22) Filed: Jun. 30, 2020

(65) Prior Publication Data

US 2020/0402361 A1 Dec. 24, 2020

Related U.S. Application Data

(63) Continuation-in-part of application No. 15/415,444, filed on Jan. 25, 2017, now abandoned.

(60) Provisional application No. 62/289,416, filed on Feb. 1, 2016.

(51) Int. Cl.
*G07F 17/32* (2006.01)
*G07F 17/34* (2006.01)

(52) U.S. Cl.
CPC ..... *G07F 17/3258* (2013.01); *G07F 17/3213* (2013.01); *G07F 17/34* (2013.01)

(58) Field of Classification Search
CPC ... G07F 17/32; G07F 17/3244; G07F 17/3258
USPC ..... 463/20, 25, 26, 27
See application file for complete search history.

(56) References Cited

U.S. PATENT DOCUMENTS

| | | | |
|---|---|---|---|
| 5,344,144 | A | 9/1994 | Canon |
| 5,564,700 | A | 10/1996 | Celona |
| 5,655,961 | A | 8/1997 | Acres et al. |
| 5,752,882 | A | 5/1998 | Acres |
| 5,855,515 | A | 1/1999 | Pease et al. |
| 5,885,158 | A | 3/1999 | Torango et al. |
| 6,089,980 | A | 7/2000 | Gauselmann |
| 6,102,402 | A | 8/2000 | Scott et al. |
| 6,110,043 | A | 8/2000 | Olsen |
| 6,146,273 | A | 11/2000 | Olsen |
| 6,206,782 | B1 | 3/2001 | Walker et al. |

(Continued)

FOREIGN PATENT DOCUMENTS

| | | |
|---|---|---|
| WO | 00/04472 | 1/2000 |
| WO | 2004/033055 | 4/2004 |

(Continued)

*Primary Examiner* — Chase E Leichliter
(74) *Attorney, Agent, or Firm* — Neal, Gerber & Eisenberg LLP

(57) ABSTRACT

A gaming system including one or more progressive awards. Each progressive award is associated with a plurality of different progressive award reset values. Upon a progressive award triggering event occurring and the progressive award being provided to one or more players, the gaming system resets the progressive award to a randomly selected one of the plurality of different progressive award reset values associated with the provided progressive award. Thus, upon a determination to provide a progressive award to a player, that progressive award is reset to a randomly selected value which may be above the reset value historically associated with such a progressive award.

14 Claims, 8 Drawing Sheets

(56) References Cited

U.S. PATENT DOCUMENTS 6,210,275 B1 4/2001 Olsen
6,241,608 B1 * 6/2001 Torango ..... G07F 17/32 463/16
6,319,125 B1 11/2001 Acres
6,358,149 B1 3/2002 Schneider et al.
6,413,161 B1 7/2002 Baerlocher et al.
6,416,409 B1 7/2002 Jordan
6,435,511 B1 8/2002 Vancura et al.
6,435,968 B1 8/2002 Torango
6,439,995 B1 8/2002 Hughs-Baird et al.
6,565,434 B1 5/2003 Acres
6,585,591 B1 7/2003 Baerlocher et al.
6,592,460 B2 7/2003 Torango
6,595,854 B2 7/2003 Hughs-Baird et al.
6,599,193 B2 7/2003 Baerlocher et al.
6,605,001 B1 8/2003 Tarantino
6,632,140 B2 10/2003 Berman et al.
6,634,943 B1 10/2003 Baerlocher
6,634,945 B2 10/2003 Glavich et al.
6,656,048 B2 12/2003 Olsen
6,712,695 B2 3/2004 Mothwurf et al.
6,726,563 B1 4/2004 Baerlocher et al.
6,733,386 B2 5/2004 Cuddy et al.
6,802,773 B2 10/2004 Moody
6,887,154 B1 5/2005 Luciano, Jr. et al.
6,910,962 B2 6/2005 Marks et al.
6,910,964 B2 6/2005 Acres
6,932,701 B2 8/2005 Glavich et al.
6,966,834 B1 11/2005 Johnson
6,991,538 B2 1/2006 Cannon
6,997,804 B2 2/2006 Berman
7,056,213 B2 6/2006 Ching et al.
7,056,215 B1 6/2006 Olive
7,070,505 B2 7/2006 Vancura et al.
7,074,127 B2 7/2006 Cuddy et al.
7,081,050 B2 7/2006 Tarantino
7,090,580 B2 8/2006 Rodgers et al.
7,094,148 B2 8/2006 Baerlocher et al.
7,108,603 B2 9/2006 Olive
7,204,756 B2 4/2007 Jubinville et al.
7,233,911 B1 6/2007 Stollery
7,273,415 B2 9/2007 Cregan et al.
7,291,067 B2 11/2007 Tarantino
7,311,598 B2 12/2007 Kaminkow et al.
7,311,604 B2 12/2007 Kaminkow et al.
7,357,716 B2 4/2008 Marks et al.
7,371,169 B2 5/2008 Baerlocher
7,371,170 B2 5/2008 Cregan et al.
7,393,280 B2 7/2008 Cannon
7,427,236 B2 9/2008 Kaminkow et al.
7,448,949 B2 11/2008 Kaminkow et al.
7,470,184 B2 12/2008 Baerlocher et al.
7,481,430 B1 1/2009 Jackson et al.
7,500,913 B2 3/2009 Baerlocher
7,500,914 B2 3/2009 Rodgers et al.
7,500,915 B2 3/2009 Wolf et al.
7,530,896 B2 5/2009 Gauselmann
7,533,886 B2 5/2009 Kenny et al.
7,568,973 B2 8/2009 Iddings et al.
7,578,739 B2 8/2009 Gauselmann
7,585,222 B2 9/2009 Muir
7,601,060 B2 10/2009 Baerlocher et al.
7,651,392 B2 1/2010 Pennington et al.
7,914,377 B2 3/2011 Benbrahim et al.
7,963,845 B2 6/2011 Baerlocher
8,070,597 B2 12/2011 Cuddy
8,157,646 B2 4/2012 Pawloski et al.
8,197,337 B2 6/2012 Dewaal et al.
8,210,937 B2 7/2012 Cregan et al.
8,328,631 B2 12/2012 Baerlocher
8,337,298 B2 12/2012 Baerlocher
8,342,958 B2 1/2013 Cuddy et al.
8,408,994 B2 4/2013 Baerlocher et al.
8,449,388 B2 5/2013 Nicely et al.
8,500,548 B2 8/2013 Baerlocher et al.
8,523,665 B2 * 9/2013 Baerlocher ..... G07F 17/3244 463/27
8,968,083 B2 3/2015 Nicely et al.
9,064,379 B2 6/2015 Pawloski et al.
9,092,941 B2 7/2015 Baerlocher et al.
9,202,338 B2 12/2015 Lafky et al.
9,245,417 B2 1/2016 Olsen
2001/0003710 A1 * 6/2001 Abramopoulos ... G07F 17/3227 463/27
2001/0004607 A1 6/2001 Olsen
2001/0036857 A1 11/2001 Mothwurf et al.
2002/0142846 A1 10/2002 Paulsen
2002/0151354 A1 10/2002 Boesen et al.
2002/0169015 A1 11/2002 Moody
2002/0177483 A1 11/2002 Cannon
2003/0011127 A1 1/2003 Vancura et al.
2003/0092484 A1 5/2003 Schneider et al.
2003/0093168 A1 5/2003 Nagaoka
2003/0148807 A1 8/2003 Acres
2003/0181231 A1 9/2003 Vancura et al.
2003/0222402 A1 12/2003 Olive
2003/0224852 A1 12/2003 Walker et al.
2004/0048644 A1 3/2004 Gerrard et al.
2004/0053669 A1 3/2004 Gerrard et al.
2004/0063499 A1 4/2004 Schneider et al.
2004/0106448 A1 6/2004 Gauselmann
2005/0037837 A1 2/2005 Rowe
2005/0054430 A1 3/2005 Pitman et al.
2005/0054436 A1 3/2005 Frizzell et al.
2005/0059446 A1 3/2005 Kaminkow
2005/0059481 A1 3/2005 Joshi et al.
2005/0064930 A1 3/2005 Jubinville et al.
2005/0119043 A1 6/2005 Berman et al.
2005/0119047 A1 6/2005 Olive
2005/0143166 A1 6/2005 Walker et al.
2005/0176488 A1 8/2005 Olive
2005/0209004 A1 9/2005 Torango
2005/0239542 A1 10/2005 Olsen
2006/0003829 A1 1/2006 Thomas
2006/0025195 A1 2/2006 Pennington et al.
2006/0030403 A1 2/2006 Lafky et al.
2006/0035694 A1 2/2006 Fuller
2006/0040723 A1 2/2006 Baerlocher et al.
2006/0052159 A1 3/2006 Cahill et al.
2006/0052161 A1 3/2006 Soukup et al.
2006/0052162 A1 3/2006 Soukup et al.
2006/0068882 A1 3/2006 Baerlocher et al.
2006/0073887 A1 4/2006 Nguyen et al.
2006/0073889 A1 4/2006 Edidin et al.
2006/0073897 A1 4/2006 Englman et al.
2006/0084494 A1 4/2006 Belger et al.
2006/0100019 A1 5/2006 Hornik et al.
2006/0154718 A1 7/2006 Willyard et al.
2006/0183535 A1 8/2006 Marks et al.
2006/0183537 A1 8/2006 Dickerson
2006/0183538 A1 8/2006 Michaelson et al.
2006/0217170 A1 9/2006 Roireau
2006/0258424 A1 11/2006 Green
2006/0287077 A1 12/2006 Grav et al.
2007/0054733 A1 3/2007 Baerlocher
2007/0060320 A1 3/2007 Kelly et al.
2007/0075497 A1 4/2007 Friedman
2007/0077990 A1 4/2007 Cuddy et al.
2007/0105619 A1 5/2007 Kniesteadt et al.
2007/0105620 A1 5/2007 Cuddy et al.
2007/0111786 A1 5/2007 Snow
2007/0155485 A1 7/2007 Cuddy et al.
2007/0167217 A1 7/2007 Kaminkow et al.
2007/0184887 A1 8/2007 Cannon
2007/0184896 A1 8/2007 Dickerson
2007/0218982 A1 9/2007 Baerlocher
2007/0259711 A1 11/2007 Thomas
2007/0298874 A1 12/2007 Baerlocher et al.
2008/0020832 A1 1/2008 Iddings et al.
2008/0039191 A1 2/2008 Cuddy
2008/0076532 A1 3/2008 Graham et al.
2008/0076542 A1 3/2008 Iddings et al.
2008/0090651 A1 * 4/2008 Baerlocher ..... G07F 17/3244 463/27

(56) References Cited

U.S. PATENT DOCUMENTS

| | | | |
|---|---|---|---|
| 2008/0102916 | A1 | 5/2008 | Kovacs et al. |
| 2008/0102920 | A1 | 5/2008 | Baerlocher |
| 2008/0108401 | A1 | 5/2008 | Baerlocher et al. |
| 2008/0108410 | A1 | 5/2008 | Baerlocher |
| 2008/0108412 | A1 | 5/2008 | Snow et al. |
| 2008/0108423 | A1 | 5/2008 | Benbrahim et al. |
| 2008/0108429 | A1 | 5/2008 | Davis et al. |
| 2008/0108430 | A1 | 5/2008 | Evans |
| 2008/0108431 | A1 | 5/2008 | Cuddy et al. |
| 2008/0113765 | A1 | 5/2008 | DeWaal |
| 2008/0113771 | A1 | 5/2008 | Baerlocher et al. |
| 2008/0113779 | A1 | 5/2008 | Cregan |
| 2008/0139274 | A1 | 6/2008 | Baerlocher |
| 2008/0153564 | A1 | 6/2008 | Baerlocher et al. |
| 2008/0220841 | A1 | 9/2008 | Gagner et al. |
| 2008/0224402 | A1 | 9/2008 | Snow et al. |
| 2008/0274790 | A1 | 11/2008 | Cannon |
| 2008/0277871 | A1 | 11/2008 | Saheki |
| 2009/0011827 | A1 | 1/2009 | Englman et al. |
| 2009/0036202 | A1 | 2/2009 | Baerlocher et al. |
| 2009/0042644 | A1 | 2/2009 | Zielinski |
| 2009/0042645 | A1 | 2/2009 | Graham et al. |
| 2009/0088244 | A1 | 4/2009 | Nicely et al. |
| 2009/0088253 | A1 | 4/2009 | Oberberger et al. |
| 2009/0093298 | A1 | 4/2009 | Michel |
| 2009/0098932 | A1 | 4/2009 | Longway |
| 2009/0111560 | A1 | 4/2009 | Davis et al. |
| 2009/0111561 | A1 | 4/2009 | Dewaal et al. |
| 2009/0117970 | A1 | 5/2009 | De Waal et al. |
| 2009/0117979 | A1 | 5/2009 | Decasa, Jr. et al. |
| 2009/0124320 | A1 | 5/2009 | DeWaal |
| 2009/0124327 | A1 | 5/2009 | Caputo et al. |
| 2009/0124362 | A1 | 5/2009 | Cuddy et al. |
| 2009/0124363 | A1 | 5/2009 | Baerlocher et al. |
| 2009/0124364 | A1 | 5/2009 | Cuddy et al. |
| 2009/0124385 | A1 | 5/2009 | Cuddy et al. |
| 2010/0261524 | A1* | 10/2010 | Pawloski ..... G07F 17/32 463/27 |
| 2011/0201403 | A1* | 8/2011 | Jaffe ..... G07F 17/3258 463/20 |
| 2011/0201416 | A1* | 8/2011 | Jaffe ..... G07F 17/3258 463/27 |
| 2014/0004932 | A1* | 1/2014 | Baerlocher ..... G07F 17/3244 463/26 |
| 2014/0364203 | A1* | 12/2014 | Nelson ..... G07F 17/3218 463/31 |
| 2015/0072783 | A1* | 3/2015 | Nicely ..... G07F 17/32 463/31 |
| 2016/0314657 | A1* | 10/2016 | Buchholz ..... G07F 17/3258 |
| 2017/0221309 | A1* | 8/2017 | Hughes ..... G07F 17/3258 |

FOREIGN PATENT DOCUMENTS

| | | |
|---|---|---|
| WO | 2005/036328 | 4/2005 |
| WO | 2005/048157 | 5/2005 |
| WO | 2007/015887 | 2/2007 |
| WO | 2007/024584 | 3/2007 |
| WO | 2007/030733 | 3/2007 |
| WO | 2007/030801 | 3/2007 |
| WO | 2007/087297 | 8/2007 |
| WO | 2007/117502 | 10/2007 |
| WO | 2007/127259 | 11/2007 |

* cited by examiner

1000

GAMING SYSTEM AND METHOD FOR PROVIDING RANDOMLY DETERMINED PROGRESSIVE AWARD RESET VALUES

PRIORITY CLAIM

This application is a continuation-in-part of, and claims priority to and the benefit of, U.S. patent application Ser. No. 15/415,444, which was filed Jan. 25, 2017, which is a continuation of, and claims priority to and benefit of U.S. Provisional Patent Application No. 62/289,416, filed on Feb. 1, 2016, the entire contents of which are incorporated by reference herein.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In such known gaming machines, the amount of the wager made on the base game by the player may vary. For instance, the gaming machine may enable the player to wager a minimum number of credits, such as one credit (e.g., one penny, nickel, dime, quarter or dollar) up to a maximum number of credits, such as five credits. In many of these gaming machines, the award is based on the player obtaining a winning symbol or symbol combination and on the amount of the wager (e.g., the higher the wager, the higher the award). Symbols or symbol combinations which are less likely to occur usually provide higher awards.

Secondary or bonus games are also known in gaming machines. The secondary or bonus games usually provide an additional award to the player. Secondary or bonus games usually do not require an additional wager by the player to be activated. Secondary or bonus games are generally activated or triggered upon an occurrence of a triggering symbol or triggering symbol combination in the primary or base game. Part of the enjoyment and excitement of playing certain gaming machines is the occurrence or triggering of the secondary or bonus game (even before the player knows how much the bonus award will be).

Progressive awards associated with gaming machines are also known. In one form, a progressive award is an award amount which includes or starts at an initial amount or value funded by a casino and an additional amount funded through a portion of each wager made on the progressive gaming machines. For example, a progressive award increment rate of 0.1% of each wager placed on the primary games of the gaming machines associated with the progressive award may be allocated to the progressive award or progressive award fund or pool. The progressive award grows in value as more players play the gaming machines and more portions of these players' wagers are allocated to the progressive award. When a player obtains a winning symbol or winning symbol combination associated with the progressive award, the accumulated progressive award is provided to the player. After the progressive award is provided to the player, the amount of the next progressive award is reset to the initial value and a portion of each subsequent wager on a gaming machine associated with a progressive award is allocated to the next progressive award.

A progressive award may be associated with or otherwise dedicated to a single or stand-alone gaming machine. Alternatively, a progressive award may be associated with or otherwise dedicated to multiple gaming machines which each contribute a portion of wagers placed at such gaming device(s) to the progressive award. The multiple gaming machines may be in the same bank of gaming machines, in the same casino or gaming establishment (usually through a local area network ("LAN")) or in two or more different casinos or gaming establishments (usually through a wide area network ("WAN")). Such progressive awards are played for by one or more gaming machines in the same gaming establishment sometimes called local area progressives ("LAP") and such progressive awards played for by a plurality of gaming machines at a plurality of different gaming establishments are sometimes called wide area progressives ("WAP").

Moreover, a gaming device or bank of gaming machines may be simultaneously associated with a plurality of progressive awards. In these multi-level progressive ("MLP") configurations, a plurality of progressive awards start at different award or value levels, such as $10, $100, $1000 and $10,000 and each individually increment or increase until provided to a player. Upon a suitable triggering event at one of more of the gaming machines associated with the MLP, one or more of the progressive awards which form the MLP are provided to one or more of the players at such gaming machines.

While such progressives are popular amongst players, a number of potential problems exist with these known progressive award systems. One problem is that after a progressive award is provided to one or more players, the next progressive award often takes a substantial period of time to climb back to a relatively high value. This discourages certain players who do not wish to play for a base or reset level progressive award. Such discouragement, often known as jackpot fatigue, can lead to players walking away from the gaming machines of the progressive award gaming system because they no longer find the progressive award desirable or worth the cost of continuing to play because the progressive award is at a relatively low level. This desire to quit playing is also due to the fact that a player may feel they must wait a substantial period of time for the jackpot to climb back to a high value. That is, when a progressive award is provided at a different gaming machine, a player may feel deflated and not wish to continue playing for a base or reset level progressive award.

Another problem that exists with such known progressive award gaming systems is that if the progressive award is initially implemented in association with a relatively small number of gaming machines, the progressive award initially increments at a relatively slow growth or incremental rate. That is, without a relatively large number of players playing at gaming machines associated with the progressive award, the progressive award increments at an unattractive rate and takes a substantial period of time to climb to a high value. This situation may also cause certain players not to play at the gaming machines associated with the progressive award because they do not find the progressive award desirable or worth the playing. Such players avoiding the gaming machines associated with the progressive award further slows the growth rate of the progressive award which in turn causes it to take a longer period of time for the progressive award to climb to a high value.

Accordingly, there is a continuing need to provide new and different gaming machines and gaming systems which provide one or more progressive awards to one or more players.

SUMMARY

In various embodiments, the gaming system disclosed herein includes one or more progressive awards. Each progressive award is associated with a plurality of different progressive award reset values. In these embodiments, upon a progressive award triggering event occurring and the progressive award being provided to one or more players, the gaming system resets the progressive award to a randomly selected one of the plurality of different progressive award reset values associated with the provided progressive award. That is, upon a determination to provide a progressive award to a player, that progressive award is reset to a randomly selected value which may be above the reset value historically associated with such a progressive award. Such a resetting of a progressive award to a higher progressive award reset value counteracts jackpot fatigue and provides a more enjoyable and entertaining gaming experience for players.

In certain embodiments, the gaming system maintains a progressive award associated with a range of values. In one such embodiment, the maximum amount of the range of values represents a displayed amount by which the progressive award must be provided to a player. In these embodiments, either upon an initial start-up of the progressive award or following the progressive award being provided to a player, the gaming system determines a progressive award hit value within the range of values associated with that progressive award. In these embodiments, the gaming system also randomly determines a starting or reset value for that progressive award. In different embodiments, the gaming system employs one or more weighted tables to select the starting or reset value for the progressive award and/or the progressive award hit value for the progressive award. It should be appreciated that when the gaming system randomly selects a starting or reset progressive award value which is relatively closer to the displayed amount by which the progressive award must be provided to a player, not only is jackpot fatigue drastically reduced, but certain players enjoy the increased excitement of the frenzy environment which is created as players attempt to win such a progressive award.

In these embodiments, following the selection of a progressive award hit value and the random selection of a progressive award starting or reset value, the gaming system increments the progressive award from the randomly selected progressive award starting or reset value. In one such embodiment, the gaming system increments the progressive award with a configured percent of coin-in. In these embodiments, the gaming system continues to increment the progressive award until the gaming system determines that the progressive award equals the determined progressive award hit value. Upon such a determination that the progressive award equals the determined progressive award hit value, the gaming system provides the progressive award to one or more players and proceeds as described above with determining another progressive award hit value and another randomly selected progressive award reset value.

For example, following a progressive award associated with a range of $10 (i.e., a minimum reset amount) and a $25 (i.e., a maximum or must-hit amount) being provided to a player, the gaming system randomly selects a progressive award hit value of $22.15 and a randomly selected reset value of $19.00. The gaming system proceeds to reset the progressive award to $19.00 and begins incrementing the progressive award from the randomly selected $19.00 reset value to the progressive award hit value of $22.15. It should be appreciated that as demonstrated in this example, since certain players might experience jackpot fatigue thinking about the substantial period of time for the progressive award to potentially grow by the $15.00 difference between the progressive award minimum reset value of $10 and the progressive award must-hit value of $25, certain of such players may not feel deflated and rather become excited at the relative low difference between the randomly selected progressive award minimum reset value of $19 and the progressive award must-hit value of $25.

Accordingly, such as configuration of utilizing a randomly selected progressive award starting or reset value along with a capped progressive award (i.e., a progressive award associated with a displayed maximum value by which the progressive award is guaranteed to be provided by) eliminates or reduces certain of the above-described problems which currently exist with known progressive award systems.

Additional features and advantages are described in, and will be apparent from, the following Detailed Description and the figures.

DETAILED DESCRIPTION

Random Progressive Award Reset Values

In various embodiments, the gaming system disclosed herein includes one or more progressive awards. Each progressive award is associated with a plurality of different progressive award reset values. In these embodiments, upon a progressive award triggering event occurring and the progressive award being provided to one or more players, the gaming system resets the progressive award to a randomly selected one of the plurality of different progressive award reset values associated with the provided progressive award. That is, upon a determination to provide a progressive award to a player, that progressive award is reset to a randomly selected value which may be above the reset value historically associated with such a progressive award. Such a resetting of a progressive award to a higher progressive award reset value counteracts jackpot fatigue and provides a more enjoyable and entertaining gaming experience for players.

It should be appreciated that while the player's credit balance, the player's wager, and any awards are displayed as an amount of monetary credits or currency in the embodiments described below, one or more of such player's credit balance, such player's wager, and any awards provided to such player may be for non-monetary credits, promotional credits, and/or player tracking points or credits.

Figure 1:
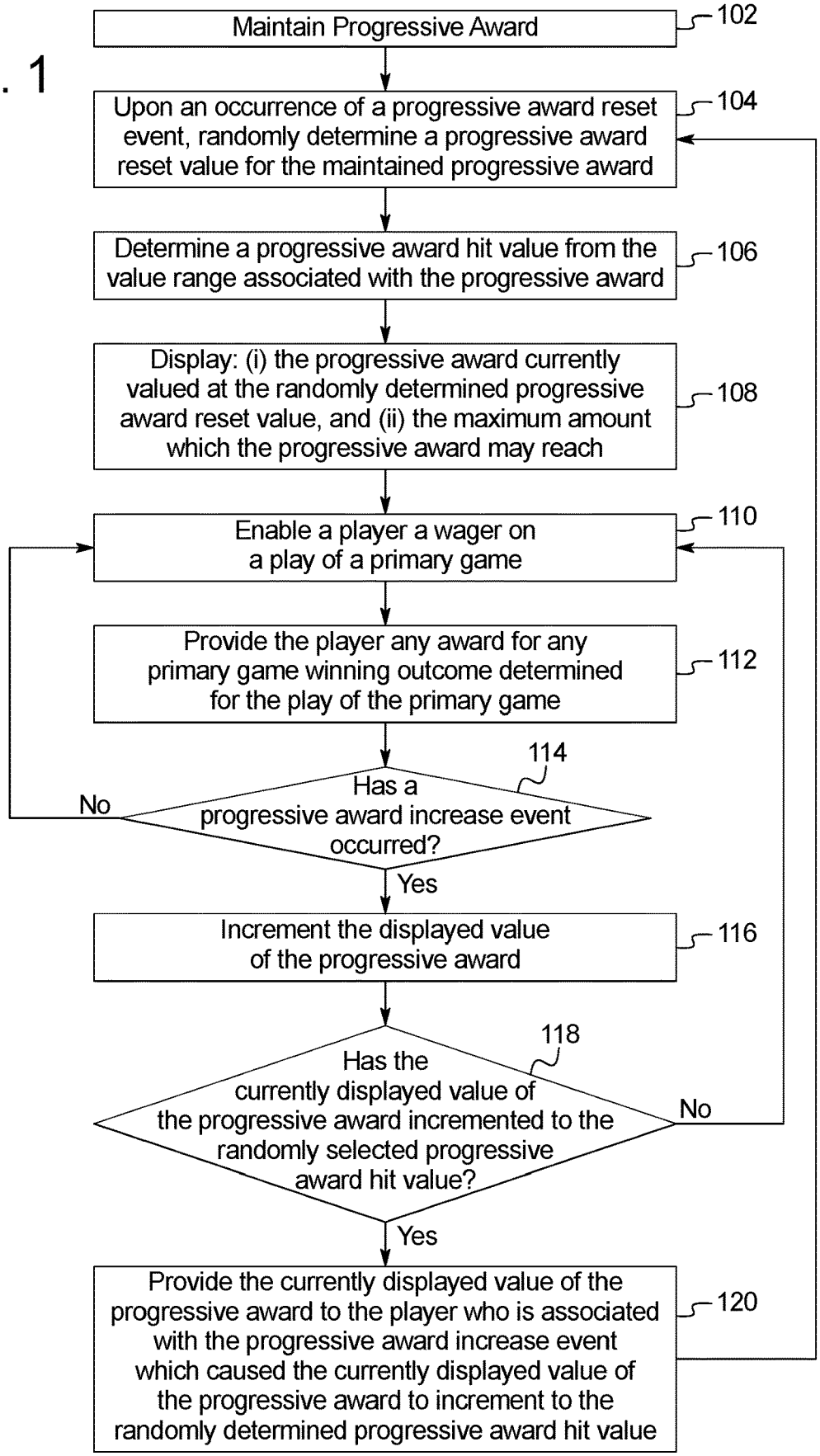
FIG. 1 is a flow-chart of one embodiment of the gaming system disclosed herein illustrating a random determination of a progressive award reset value for a capped progressive award.

FIG. 1 is a flowchart of an example process or method of operating the gaming system of the present disclosure. In various embodiments, the process is represented by a set of instructions stored in one or more memories and executed by one or more processors. Although the process is described with reference to the flowchart shown in FIG. 1, many other processes of performing the acts associated with this illustrated process may be employed. For example, the order of certain of the illustrated blocks or diamonds may be changed, certain of the illustrated blocks or diamonds may be optional, or certain of the illustrated blocks or diamonds may not be employed.

In one embodiment, as indicated in block 102, the gaming system maintains a progressive award. In one such embodiment, a single or stand-alone electronic gaming machine (EGM) in the gaming system is associated with or otherwise dedicated to the maintained progressive award. In another such embodiment, a plurality of EGMs at one or more gaming sites are networked to the central server in a progressive configuration with the maintained progressive award. In another such embodiment, one or more internet accessible dedicated gaming sites are associated with the maintained progressive award. It should be appreciated that while the present disclosure is described in association with a progressive award, the gaming system is configured to maintain a plurality of progressive awards wherein one, more or each of the plurality of progressive awards include one or more of the features described herein.

In one embodiment, the progressive award is associated with a range of values. The low end of the range of values represents a minimum reset value of the progressive award and the high end of the range of values represents the maximum amount which the progressive award may reach. That is, the amount which the progressive award may be incremented to is capped or limited by the highest value in the value range associated with such progressive award. In another embodiment, the progressive award is not associated with any range of values. In this embodiment, the progressive award continues to be incremented until a progressive award triggering event occurs and the gaming system provides the progressive award to a player.

In this illustrated embodiment, as indicated in block 104, upon an occurrence of a progressive award reset event, the gaming system randomly determines a progressive award reset value for the maintained progressive award. In one such embodiment, the progressive award reset event is an initial starting up of the gaming system. In this embodiment, the gaming system randomly determines the progressive award reset value following an initialization of the gaming system (i.e., the progressive award reset value is a progressive award starting value). In another such embodiment, the progressive award reset event is associated with a prior occurrence of a progressive award triggering event. In this embodiment, the gaming system randomly determines the progressive award reset value following a prior determination to provide a progressive award to a player.

In one embodiment, the progressive award is associated with a plurality of reset values and the gaming system randomly selects one of such reset values. In one such embodiment, the gaming system employs one or more weighted tables to select the progressive award reset value. In this embodiment, different progressive award reset values are associated with different probabilities and the gaming system selects one of the progressive award reset values based on such different probabilities. In certain embodiments, a progressive award reset value is determined independent of any displayed event associated with any plays of any of primary games and/or any plays of any secondary games. In certain other embodiments, a progressive award reset value is determined in association with a play of a primary game or a play of a secondary game.

In addition to randomly selecting a progressive award reset value, the gaming system determines a progressive award hit value from the value range associated with the progressive award as indicated in block 106.

In certain embodiments, the gaming system randomly selects a progressive award hit value after randomly selecting a progressive award reset value. In these embodiments, the gaming system accounts for the progressive award reset value when randomly selecting a progressive award hit value (i.e., to avoid the situation of selecting a progressive award hit value that is lower than the randomly selected progressive award reset value). In certain other embodiments, the gaming system randomly selects a progressive award reset value after randomly selecting a progressive award hit value. In these embodiments, the gaming system accounts for the progressive award hit value when randomly selecting a progressive award reset value (i.e., to avoid the situation of selecting a progressive award reset value that is higher than the randomly selected progressive award hit value).

Following the random determination of a progressive award reset value and a progressive award hit value, the gaming system displays the progressive award currently valued at the randomly determined progressive award reset value as indicated in block 108. The gaming system also displays the maximum amount which the progressive award may reach as indicated in block 108.

In one embodiment, prior to displaying the randomly selected progressive award hit value, the gaming system first displays the progressive award resetting to a default or base progressive award reset value. The gaming system then displays an event, such as a progressive award reset boost event, which causes the progressive award to increment to the randomly selected progressive award reset value.

Figure 2A:
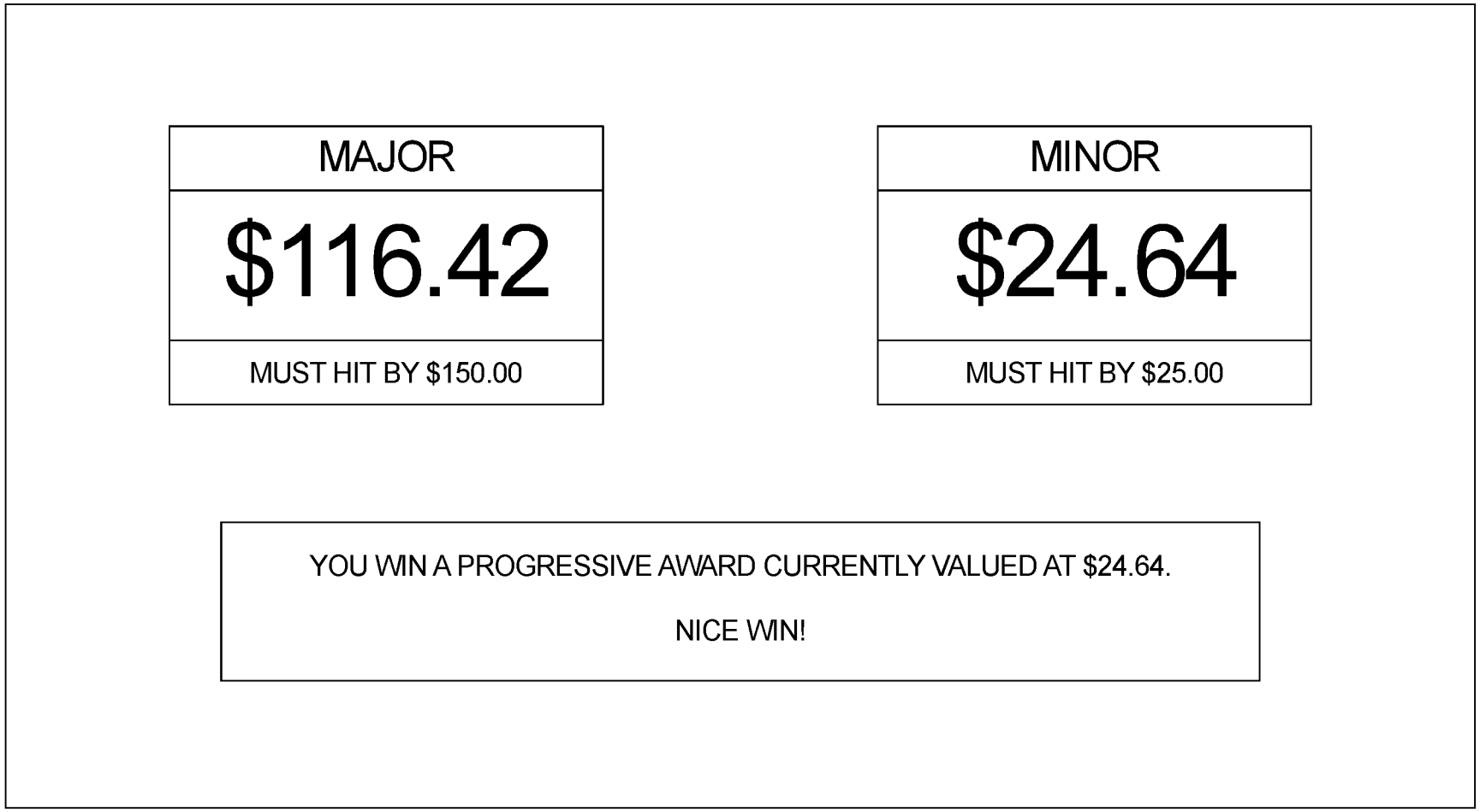
FIGS. 2A, 2B, and 2C are top plan views of a display device of one embodiment of the gaming system disclosed herein illustrating the resetting of a capped progressive award to a randomly determined reset amount.

For example, as shown in FIG. 2A, following the occurrence of a progressive award triggering event, the gaming system provides a progressive award currently valued at $24.64 to a player. In this example, the gaming system provides appropriate messages such as "YOU WIN A PROGRESSIVE AWARD CURRENTLY VALUED AT $24.64." and "NICE WIN!" to the player visually, or through suitable audio or audiovisual displays.

Figure 2B:
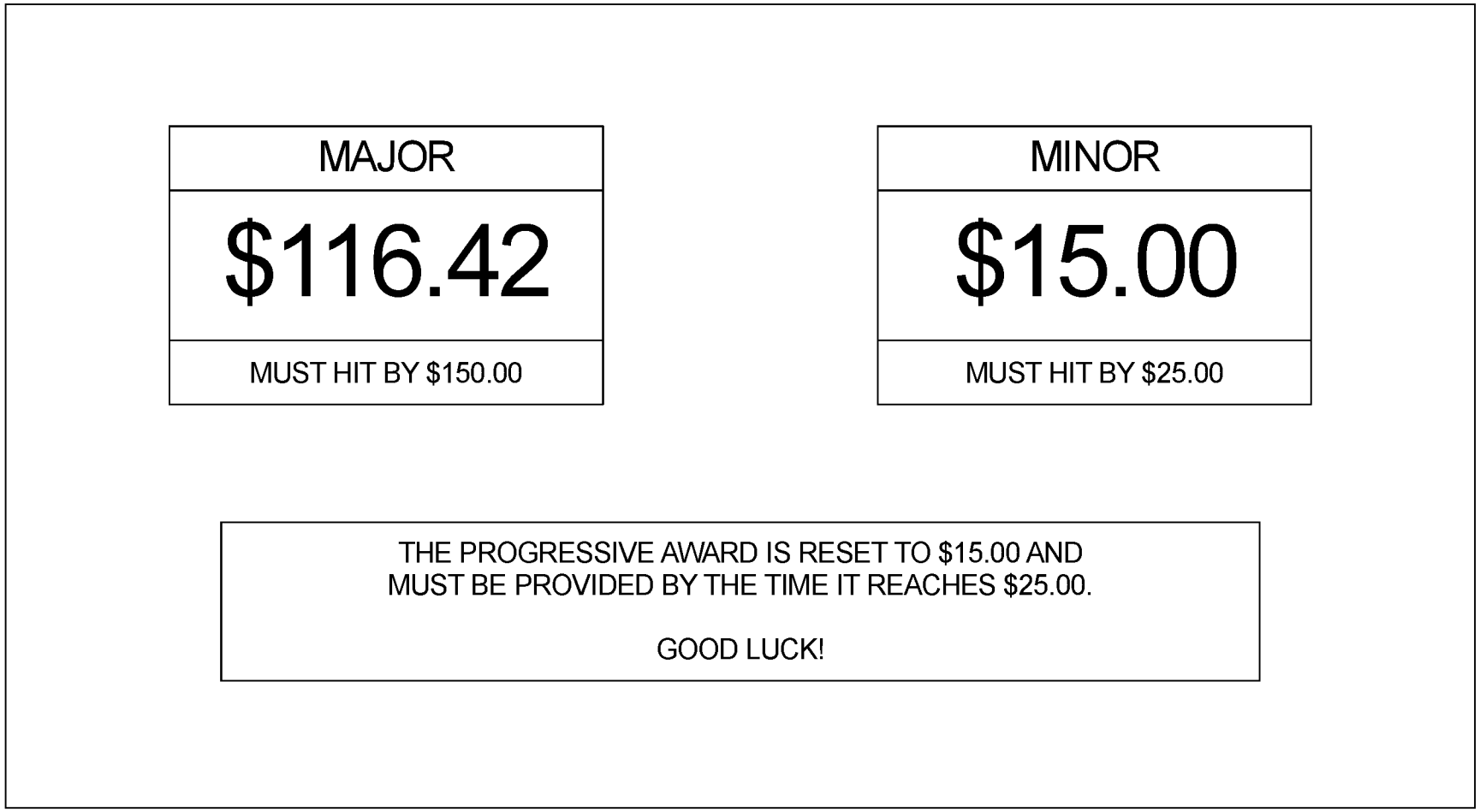

In this example, following the providing of the progressive award, as seen in FIG. 2B, the gaming system resets the progressive award to a default or base progressive award reset value of $15.00. As also seen in FIG. 2B, the gaming system displays $25.00 as the maximum amount which the progressive award may reach before the progressive award must be provided to a player. In this example, the gaming system provides appropriate messages such as "THE PROGRESSIVE AWARD IS RESET TO $15.00 AND MUST BE PROVIDED BY THE TIME IT REACHES $25.00." and "GOOD LUCK!" to the player visually, or through suitable audio or audiovisual displays.

Figure 2C:
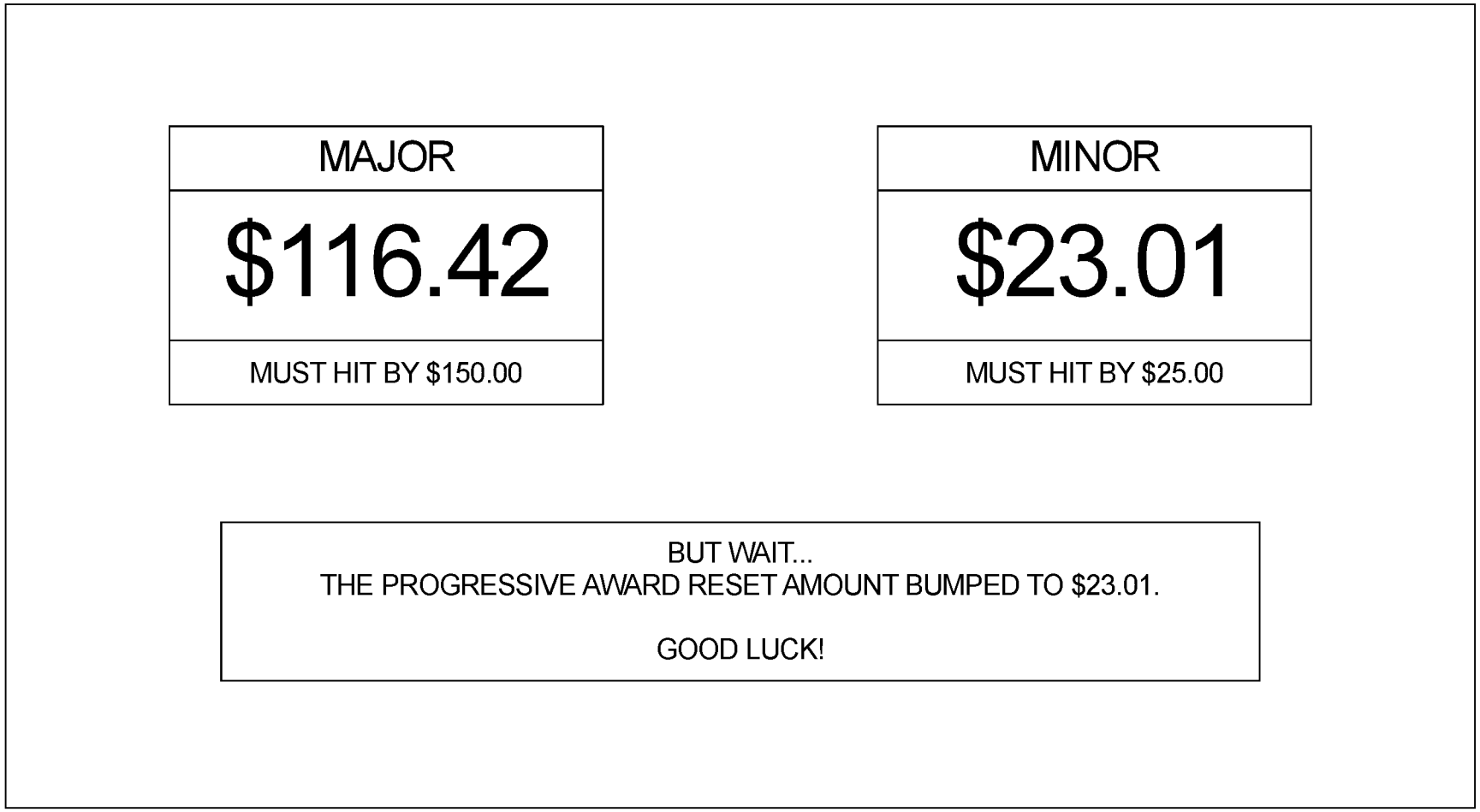

In this example, as shown in FIGS. 2B to 2C, following the display of a default of base progressive award reset value of $15.00, the gaming system displays a boost of the default progressive award reset value to a randomly selected progressive award reset value of $23.01. Such a displayed boost to the randomly selected progressive award reset value to an amount closer to the displayed maximum value by which the progressive award is guaranteed to be provided by combats jackpot fatigue by eliminating or reducing, for certain players, the deflated thoughts associated with having to potentially wait a substantial period of time for the progressive award to potentially grow from the displayed default progressive award of $15.00 to as high as the displayed maximum progressive award value of $25.00. Rather, such a displayed boost to the randomly selected progressive award reset value creates a frenzy for certain players as such players anticipate winning the progressive award relatively quickly when accounting for the relatively short period of time for the progressive award to potentially grow from the displayed randomly selected progressive award reset value of $23.01 to as high as the displayed maximum progressive award value of $25.00. In this example, the gaming system provides appropriate messages such as "BUT WAIT . . . THE PROGRESSIVE AWARD RESET AMOUNT BUMPED TO $23.01." and "GOOD LUCK!" to the player visually, or through suitable audio or audiovisual displays.

Returning to FIG. 1, after displaying the randomly selected progressive award hit value and the maximum value which the progressive award must hit by, the gaming system enables a player to place a wager on a play of a primary game as indicated in block 110. After receiving a wager from the player, the gaming system provides the player any award for any primary game winning outcome determined for the play of the primary game as indicated in block 112.

After receiving the wager from the player, the gaming system also determines if a progressive award increase event has occurred as indicated in diamond 114. In one embodiment, if a progressive award increase event has not occurred, the gaming system enables the player to place another wager on another play of the primary game as discussed above and as indicated in block 110.

On the other hand, if the gaming system determines that a progressive award increase event occurs, the gaming system increments the displayed value of the progressive award as indicated in block 116. In one embodiment, the gaming system increments the progressive award with a portion of the wager placed, wherein the portion is determined based on the progressive award contribution rate associated with the progressive award. That is, the gaming system increments or grows the maintained progressive award based on the wagers placed at the EGM or EGMs associated with the progressive award. Specifically, for the maintained progressive award, the gaming system increments or grows that maintained progressive award based on the wagers placed at the EGM or EGMs associated with that progressive award and the progressive award contribution rate associated with the progressive award. For example, for each $1.00 wagered on a EGM associated with the maintained progressive award, the gaming system increments the progressive award by $0.03 (i.e., $1.00×the progressive award contribution rate of 3% associated with the progressive award). In certain embodiments, the gaming system displays such an increase to the progressive award as a continuous growth of the progressive award.

In one embodiment, after incrementing the progressive award, the gaming system determines if the currently displayed value of the progressive award has incremented to the randomly selected progressive award hit value as indicated in diamond 118. That is, the gaming system determines if a progressive award triggering event has occurred in association with the progressive award. In another embodiment, the gaming system determines if the currently displayed value of the progressive award has incremented to within a suitable range of the randomly selected progressive award hit value.

If the currently displayed value of the progressive award has not incremented to the randomly determined progressive award hit value (or has not incremented to within a suitable range of the randomly determined progressive award hit value), the gaming system enables a player to place another wager on another play of the primary game as discussed above and as indicated in block 110.

On the other hand, if the currently displayed value of the progressive award has incremented to the randomly determined progressive award hit value, the gaming system provides the currently displayed value of the progressive award to the player who is associated with the progressive award increase event which caused the currently displayed value of the progressive award to increment to the randomly determined progressive award hit value as indicated in block 120. In an alternative embodiment, if the displayed value of a progressive award has incremented to within a suitable range of the randomly determined progressive award hit value, the gaming system provides the then currently displayed value of the progressive award.

Following providing the progressive award to a player, the gaming system returns to block 104 and proceeds as described above with randomly determining another a progressive award reset value for the maintained progressive award.

In one embodiment, as mentioned above, the gaming system maintains a plurality of progressive awards. In this embodiment, each progressive award is associated with a different range of values and a different plurality of progressive award reset values, wherein upon an occurrence of a progressive award reset event for any of the progressive awards, the gaming system randomly determines a progressive award reset value for that progressive award. In one such embodiment wherein the gaming system employs one or more weighted tables to select the progressive award reset value for each progressive award, the weighted tables are configured respective to the range of values associated with each progressive award. For example, for a progressive award with a relatively lower valued range of values, such as a progressive award with a value range between $10 and $25 which the progressive award hit value is selected from, the weighted table favors the random selection of a higher valued progressive award reset value. In this example, the gaming system is configured to reset the progressive award to a value relatively closer to the must hit value of $25.

It should be appreciated that while the random selection of a progressive award reset value is described herein in relation to potentially creating a frenzy in association with a capped progressive award (i.e., a progressive award which must be provided by the time the progressive award increments to the highest value in the value range associated with the progressive award), the gaming system is configured to randomly select a progressive award reset value in association with an uncapped progressive award. Such a random selection of a progressive award reset value of an uncapped progressive award (i.e., a progressive award that is not guaranteed to hit by a certain value) still combats jackpot fatigue by potentially utilizing a higher starting progressive award which players find more exciting to play for.

It should be further appreciated that while the long-term average expected payback percentage of the gaming system disclosed herein remains relatively unchanged by the random selection of different progressive award reset values, the short-term average expected payback percentage of the gaming system may fluctuate based on which progressive award reset value is randomly selected. That is, if a plurality of higher-valued progressive award reset values are each randomly selected during a designated period of time, such progressive awards will increment to the respective progressive award hit values more quickly during the designated period of time and the total payout to players in the form of progressive awards will be greater during the designated period of time. This increased total progressive award payout during the designated period of time will result in a higher average expected payback percentage during the designated period of time.

The gaming system can monitor the actual payback percentage and modify the available progressive award reset values and progressive award hit values to achieve a target payback percentage. The gaming system can be configured to achieve a mean or median payback percentage over a specified period of time or sliding window of time. As the payback percentage deviates from the specified payback percentage, the gaming system can remove progressive award reset values or hit values from the range of available values. For example, if the payback percentage is exceeding a target mean or median payback percentage by a specified amount or percentage, the gaming system removes one or more of the higher progressive award reset values and/or hit values in the range of available values. Conversely, if the payback percentage is below a target mean or median payback percentage by a specified amount or percentage, the gaming system removes one or more of the lower progressive award reset values and/or hit values in the range of available values. The number of values removed from the range can be based on the amount or percentage for which the gaming system is deviating from the target payback percentage. Alternatively, instead of removing values from a range of values, the gaming system utilize an upper and lower threshold for progressive award reset values and/or hit values that are adjusted in order to achieve a target mean or median expected payback percentage. The gaming system continues to randomly select progressive values until values which fall within the upper and lower thresholds are selected. Additionally, the gaming system can adjust the target payback percentage based on criteria such as the time of day, day of the week, number of patrons in the gaming establishment, amount of coin in/out on the gaming system, a player's loyalty status, etc. The gaming system can perform similar operations to those described to modify an expected payback percentage. Whereas the above operations attempt to correct a current payback percentage for the gaming system based on prior play, adjusting the expected payback percentage modifies the future potential payback percentage of the gaming system. For example, a gaming establishment may run a promotion for a higher expected payback percentage on the gaming system. In such an instance, the gaming system could remove one or more of the lower progressive award reset values and/or hit values in the range of available values to adjust the expected payback percentage higher.

In one embodiment, as described above, each time the progressive award is reset (either upon a progressive award being provided to a player or an initialization of the progressive award), the gaming system randomly selects a progressive award reset value. In another embodiment, the gaming system randomly selects a progressive award reset value if a random progressive award reset value triggering event occurs. In this embodiment, if a random progressive award reset value triggering event occurs, the gaming system randomly selects a progressive award reset value as described herein. On the other hand, if a random progressive award reset value triggering event does not occur, the gaming system utilizes a default or predetermined progressive award reset value. In certain embodiments, a random progressive award reset value triggering event is determined independent of any displayed event associated with any plays of any of primary games and/or any plays of any secondary games. In certain other embodiments, a random progressive award reset value triggering event is determined in association with a play of a primary game or a play of a secondary game.

As described above, in certain embodiments, the gaming system determines a progressive award reset value in association with an event displayed to the player. In one embodiment, the gaming system employs one or more secondary games to select the progressive award reset value. In one such embodiment, a secondary game includes a progressive award reset value generator, such as a wheel with each of the different available progressive award reset values indicated in a different section of the wheel. In this embodiment, the progressive award reset value generator spins and the progressive award reset value indicated by an indicator determines which progressive award reset value to select. In another such embodiment, a secondary game includes a progressive award reset value reel with different symbol display positions associated with the different available progressive award reset values. In this embodiment, the progressive award reset value reel spins and the progressive award reset value associated with the symbol display position which aligns with a payline determines the progressive award reset value. In another such embodiment, a secondary game includes a plurality of selections wherein each of the selections is associated with one of the progressive award reset value. In this embodiment, the gaming system enables the player to pick one or more selections wherein the gaming system determines which progressive award reset value to select based on the player's picked selections. In another such embodiment, a secondary game includes a game of skill wherein the value of the progressive award reset value corresponds to the player's performance as compared to a baseline performance level of the skill game.

It should be appreciated that any suitable secondary game may be employed in association with determining the progressive award reset value. For example, in different embodiments, one or more secondary games utilized to determine a progressive award reset value include, but are not limited to:

i. a play of any suitable slot game;
ii. a play of any suitable free spins or free game activations;
iii. a play of any suitable wheel game;
iv. a play of any suitable card game;
v. a play of any suitable offer and acceptance game;
vi. a play of any suitable award ladder game;
vii. a play of any suitable puzzle-type game;
viii. a play of any suitable persistence game;
ix. a play of any suitable selection game;
x. a play of any suitable cascading symbols game;
xi. a play of any suitable ways to win game;

xii. a play of any suitable scatter pay game;
xiii. a play of any suitable coin-pusher game;
xiv. a play of any suitable elimination game;
xv. a play of any suitable stacked wilds game;
xvi. a play of any suitable trail game;
xvii. a play of any suitable bingo game;
xviii. a play of any suitable video scratch-off game;
xix. a play of any suitable pick-until-complete game;
xx. a play of any suitable shooting simulation game;
xxi. a play of any suitable racing game;
xxii. a play of any suitable promotional game;
xxiii. a play of any suitable high-low game;
xxiv. a play of any suitable lottery game;
xxv. a play of any suitable number selection game;
xxvi. a play of any suitable dice game;
xxvii. a play of any suitable skill game;
xxviii. a play of any suitable auction game;
xxix. a play of any suitable reverse-auction game;
xxx. a play of any suitable group game;
xxxi. a play of any suitable game in a service window;
xxxii. a play of any suitable game on a mobile device; and/or
xxxiii. a play of any suitable game disclosed herein.

In different embodiments, one or more awards provided in association with one or more primary game plays, one or more secondary game plays, and/or one or more progressive awards include one or more of: a quantity of monetary credits, a quantity of non-monetary credits, a quantity of promotional credits, a quantity of player tracking points, a progressive award (for such primary or secondary game plays), a modifier, such as a multiplier, a quantity of free plays of one or more games, a quantity of plays of one or more secondary or bonus games, a multiplier of a quantity of free plays of a game, one or more lottery based awards, such as lottery or drawing tickets, a wager match for one or more plays of one or more games, an increase in the average expected payback percentage for one or more plays of one or more games, one or more comps, such as a free dinner, a free night's stay at a hotel, a high value product such as a free car, or a low value product such as a free teddy bear, one or more bonus credits usable for online play, a lump sum of player tracking points or credits, a multiplier for player tracking points or credits, an increase in a membership or player tracking level, one or more coupons or promotions usable within and/or outside of the gaming establishment (e.g., a 20% off coupon for use at a convenience store), virtual goods associated with the gaming system, virtual goods not associated with the gaming system, an access code usable to unlock content on an internet.

In one embodiment, the gaming system causes at least one display device of at least one electronic gaming machine to display any event including any primary game, any secondary game and/or any progressive awards. In another embodiment, in addition or in alternative to each electronic gaming machine displaying any event including any primary game, any secondary game and/or any progressive awards, the gaming system causes one or more community or overhead display devices to display part or all of any event including any primary game, any secondary game and/or any progressive awards to one or more other players or bystanders either at a gaming establishment or viewing over a network, such as the internet. In another embodiment, in addition or in alternative to each electronic gaming machine displaying any event including any primary game, any secondary game and/or any progressive awards, the gaming system causes one or more internet sites to each display any event including any primary game, any secondary game and/or any progressive awards such that a player is enabled to log on from a personal web browser. In another such embodiment, the gaming system enables the player to play one or more games on one device while viewing any event including any primary game, any secondary game and/or any progressive awards from another device, such as a desktop or laptop computer.

It should be appreciated that while zero, one or more of the progressive awards having a randomly determined progressive award reset value will be provided to a player by the time such a progressive award increments to the maximum value of the range of values associated with that progressive award, in certain embodiments, such progressive awards may also be provided to a player upon an occurrence of a progressive award triggering event. That is, in certain embodiment, if one or more of the below-described progressive award triggering events occurs prior to the progressive award incrementing to the progressive award hit value, the gaming system proceeds with providing the player the progressive award.

In certain embodiments, a progressive award triggering event occurs based on an outcome associated with one or more plays of any primary games. In one embodiment, such determinations are symbol driven based on the generation of one or more designated symbols or symbol combinations. In various embodiments, a generation of a designated symbol (or sub-symbol) or a designated set of symbols (or sub-symbols) over one or more plays of a primary game causes such conditions to be satisfied and/or one or more of such events to occur.

In certain different embodiments, the gaming system does not provide any apparent reasons to the players for an occurrence of a progressive award triggering event. In these embodiments, such determinations are not triggered by an event in a primary game or based specifically on any of the plays of any primary games. That is, these events occur without any explanation or alternatively with simple explanations.

In one such embodiment, a progressive award triggering event occurs based on an amount of virtual currency-in. In this embodiment, the gaming system determines if an amount of virtual currency-in wagered reaches or exceeds a designated amount of virtual currency-in (i.e., a threshold virtual currency-in amount). Upon the amount of virtual currency-in wagered reaching or exceeding the threshold virtual currency-in amount, the gaming system causes one or more of such events or conditions to occur. In different embodiments, the threshold coin-in amount and/or the threshold virtual currency-in amount is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In another such embodiment, a progressive award triggering event occurs based on an amount of coin-out. In this embodiment, the gaming system determines if an amount of coin-out reaches or exceeds a designated amount of coin-out (i.e., a threshold coin-out amount). Upon the amount of coin-out reaching or exceeding the threshold coin-out amount, the gaming system causes one or more of such events or conditions to occur. In another such embodiment, a progressive award triggering event occurs based on an amount of virtual currency-out. In this embodiment, the gaming system determines if an amount of virtual currency-out reaches or exceeds a designated amount of virtual currency-out (i.e., a threshold virtual currency-out amount). Upon the amount of virtual currency-out reaching or exceeding the threshold virtual currency-out amount, the gaming system causes one or more of such events or conditions to occur. In different embodiments, the threshold coin-out amount and/or the threshold virtual currency-out amount is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In another embodiment, a progressive award triggering event occurs based on a predefined variable reaching a defined parameter threshold. For example, when the 500,000th player has played an electronic gaming machine (ascertained from a player tracking system), one or more of such events or conditions occur. In different embodiments, the predefined parameter thresholds include a length of time, a length of time after a certain dollar amount is hit, a wager level threshold for a specific device (which electronic gaming machine is the first to contribute $250,000), a number of electronic gaming machines active, or any other parameter that defines a suitable threshold.

In another embodiment, a progressive award triggering event occurs based on a quantity of games played. In this embodiment, a quantity of games played is set for when one or more of such events or conditions will occur. In one embodiment, such a set quantity of games played is based on historic data.

In another embodiment, a progressive award triggering event occurs based on time. In this embodiment, a time is set for when one or more of such events or conditions will occur. In one embodiment, such a set time is based on historic data.

In another embodiment, a progressive award triggering event occurs based upon gaming system operator defined player eligibility parameters stored on a player tracking system (such as via a player tracking card or other suitable manner). In this embodiment, the parameters for eligibility are defined by the gaming system operator based on any suitable criterion. In one embodiment, the gaming system recognizes the player's identification (via the player tracking system) when the player inserts or otherwise associates their player tracking card in the electronic gaming machine. The gaming system determines the player tracking level of the player and if the current player tracking level defined by the gaming system operator is eligible for one or more of such events or conditions. In one embodiment, the gaming system operator defines minimum bet levels required for such events or conditions to occur based on the player's card level.

In another embodiment, a progressive award triggering event occurs based on a system determination, including one or more random selections by the central controller. In one embodiment, as described above, the gaming system tracks all active electronic gaming machines and the wagers they placed. In one such embodiment, based on the electronic gaming machine's state as well as one or more wager pools associated with the electronic gaming machine, the gaming system determines whether to one or more of such events or conditions will occur. In one such embodiment, the player who consistently places a higher wager is more likely to be associated with an occurrence of one or more of such events or conditions than a player who consistently places a minimum wager. It should be appreciated that the criteria for determining whether a player is in active status or inactive status for determining if one or more of such events occur may the same as, substantially the same as, or different than the criteria for determining whether a player is in active status or inactive status for another one of such events to occur.

In another embodiment, a progressive award triggering event occurs based on a determination of if any numbers allotted to an electronic gaming machine match a randomly selected number. In this embodiment, upon or prior to each play of each electronic gaming machine, an electronic gaming machine selects a random number from a range of numbers and during each primary game, the electronic gaming machine allocates the first N numbers in the range, where N is the number of credits bet by the player in that primary game. At the end of the primary game, the randomly selected number is compared with the numbers allocated to the player and if a match occurs, one or more of such events or conditions occur. It should be appreciated that any suitable manner of causing a progressive award triggering event to occur may be implemented in accordance with the gaming system and method disclosed herein.

It should be appreciated that one or more of the above-described triggers pertaining to a progressive award triggering event occurring may be combined in one or more different embodiments.

In one embodiment, different progressive awards are associated with different numbers of EGMs. For example, a progressive award valued at $10,000 may be associated with ten EGMs while another progressive award valued at $500,000 may be associated with one-hundred EGMs. In one embodiment, the multiple EGMs may be in the same bank of devices, in the same casino or gaming establishment (such as through LAN), or in two or more different casinos or gaming establishments (such as through a WAN). In another embodiment, each individual EGM maintains one or more progressive awards wherein a portion of the wagers placed at that respective EGM is allocated to one or more progressive awards maintained by such individual EGM. In another embodiment, each individual EGM maintains one or more progressive awards and the central server simultaneously or substantially simultaneously maintains one or more progressive awards. In one such embodiment, the lower valued, more frequently triggered progressive awards are maintained by the individual EGMs and the higher valued, less frequently triggered progressive awards are maintained by the central server. In one embodiment, a portion of each wager placed at a designated EGM is allocated to one or more progressive awards associated with that designated EGM. In another embodiment, a portion designated wagers placed at a designated EGM, such as a portion of each maximum wager placed or a portion of each side wager placed, is allocated to one or more progressive awards associated with that designated EGM.

In one embodiment, a master host site computer is coupled to a plurality of the central servers at a variety of mutually remote gaming sites for providing a multi-site linked progressive automated gaming system. In one embodiment, a master host site computer may serve EGMs distributed throughout a number of properties at different geographical locations including, for example, different locations within a city or different cities within a state. In one embodiment, the master host site computer is maintained for the overall operation and control of the system. In this embodiment, a master host site computer oversees all or part of the progressive gaming system and is the master for computing all or part of the progressive jackpots. All participating gaming sites report to, and receive information from, the master host site computer. Each central server computer is responsible for all data communication between the EGM hardware and software and the master host site computer.

In one embodiment, different EGMs in the gaming system have different progressive awards available to the player. In one such embodiment, different types of EGMs are associated with different types of progressive awards based on the current configuration of the gaming system. In one embodiment, zero, one or more progressive awards may be associated with each of the EGMs in the gaming system while zero, one or more different progressive awards may be associated with a plurality of, but not all of the EGMs in the gaming system.

In one embodiment, one or more of the progressive awards are each funded, at least in part, via a side bet or side wager. In one such embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount on any payline (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner. In one such embodiment, one or more progressive awards are funded, at least partially, via an amount provided by one or more marketing and/or advertising departments, such as a casino's marketing department.

In one alternative embodiment, a minimum wager level is required for a EGM to qualify to be selected to obtain one of the progressive awards. In one embodiment, this minimum wager level is the maximum wager level for the primary game in the EGM. In another embodiment, this minimum wager level is placing a wager on all available paylines in a slot primary game or alternatively placing a wager on all available poker hands in a multi-hand poker primary game. In another embodiment, no minimum wager level is required for a EGM to qualify to be selected to obtain one of the progressive awards.

It should be appreciated that in different embodiments, one or more of:

i. a quantity of maintained progressive awards;
ii. a range of values associated with one or more maintained progressive awards;
iii. which progressive award hit value is selected for one or more maintained progressive awards;
iv. which progressive award reset values are available to be selected for one or more progressive awards;
v. which progressive award reset value is selected for one or more progressive awards;
vi. a progressive award contribution rate associated with one or more progressive award;
vii. whether to reset a progressive award to a default reset amount or a randomly selected reset amount (i.e., whether a random progressive award reset value triggering event occurs)
viii. whether a progressive award triggering event occurs;
ix. any determination disclosed herein;

is/are predetermined, randomly determined, determined based on a generated symbol or symbol combination, determined based on a random determination by the central controller, determined based on a random determination at the gaming system, determined based on a player's selection, determined based on one or more side wagers placed, determined based on the player's primary game wager, determined based on time (such as the time of day), determined based on an amount of coin-in accumulated in one or more pools, determined based on a status of the player (i.e., a player tracking status), or determined based on any other suitable method or criteria.

Gaming Systems

The above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. A "gaming system" as used herein refers to various configurations of: (a) one or more central servers, central controllers, or remote hosts; (b) one or more electronic gaming machines such as those located on a casino floor; and/or (c) one or more personal gaming devices, such as desktop computers, laptop computers, tablet computers or computing devices, personal digital assistants, mobile phones, and other mobile computing devices.

Thus, in various embodiments, the gaming system of the present disclosure includes: (a) one or more electronic gaming machines in combination with one or more central servers, central controllers, or remote hosts; (b) one or more personal gaming devices in combination with one or more central servers, central controllers, or remote hosts; (c) one or more personal gaming devices in combination with one or more electronic gaming machines; (d) one or more personal gaming devices, one or more electronic gaming machines, and one or more central servers, central controllers, or remote hosts in combination with one another; (e) a single electronic gaming machine; (f) a plurality of electronic gaming machines in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity and unless specifically stated otherwise, the term "EGM" is used herein to refer to an electronic gaming machine (such as a slot machine, a video poker machine, a video lottery terminal (VLT), a video keno machine, or a video bingo machine located on a casino floor). Additionally, for brevity and clarity and unless specifically stated otherwise, "EGM" as used herein represents one EGM or a plurality of EGMs, "personal computing device" as used herein represents one personal computing device or a plurality of personal computing devices, and "central server, central controller, or remote host" as used herein represents one central server, central controller, or remote host or a plurality of central servers, central controllers, or remote hosts.

Figure 3:
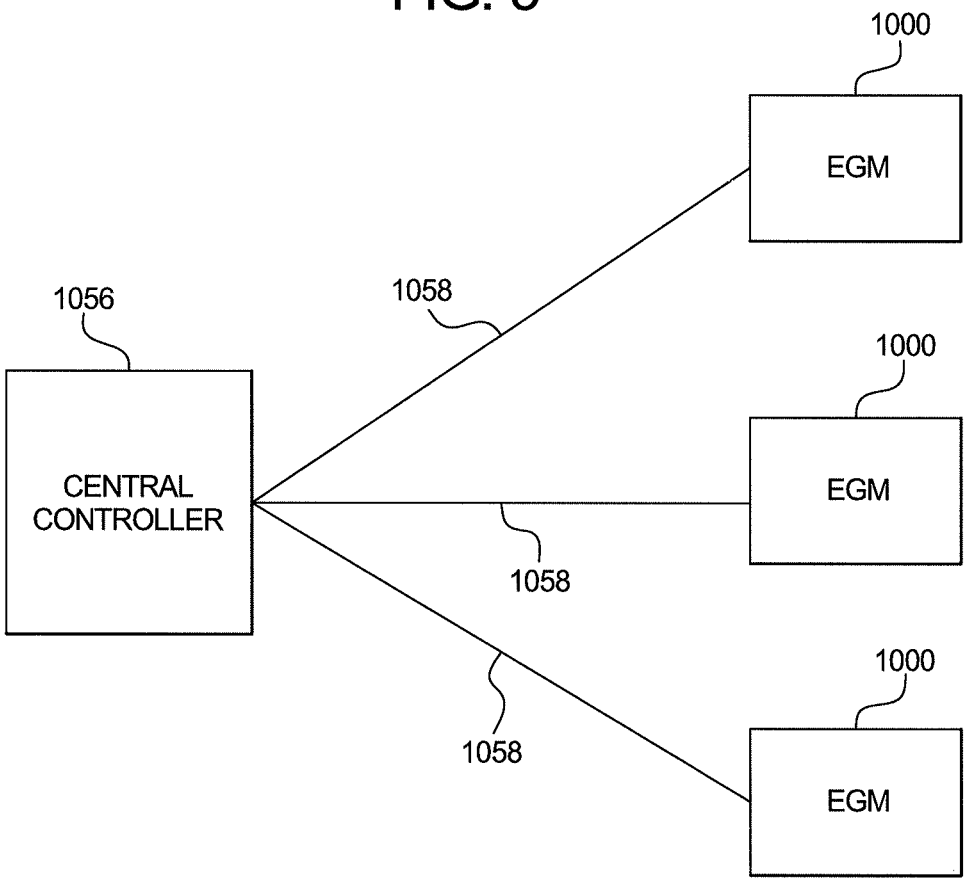
FIG. 3 is a schematic block diagram of one embodiment of a network configuration of the gaming system disclosed herein.

As noted above, in various embodiments, the gaming system includes an EGM (or personal computing device) in combination with a central server, central controller, or remote host. In such embodiments, the EGM (or personal computing device) is configured to communicate with the central server, central controller, or remote host through a data network or remote communication link. In certain such embodiments, the EGM (or personal computing device) is configured to communicate with another EGM (or personal computing device) through the same data network or remote communication link or through a different data network or remote communication link. For example, the gaming system illustrated in FIG. 3 includes a plurality of EGMs 1000 that are each configured to communicate with a central server, central controller, or remote host 1056 through a data network 1058.

In certain embodiments in which the gaming system includes an EGM (or personal computing device) in combination with a central server, central controller, or remote host, the central server, central controller, or remote host is any suitable computing device (such as a server) that includes at least one processor and at least one memory device or data storage device. As further described herein, the EGM (or personal computing device) includes at least one EGM (or personal computing device) processor configured to transmit and receive data or signals representing events, messages, commands, or any other suitable information between the EGM (or personal computing device) and the central server, central controller, or remote host. The at least one processor of that EGM (or personal computing device) is configured to execute the events, messages, or commands represented by such data or signals in conjunction with the operation of the EGM (or personal computing device). Moreover, the at least one processor of the central server, central controller, or remote host is configured to transmit and receive data or signals representing events, messages, commands, or any other suitable information between the central server, central controller, or remote host and the EGM (or personal computing device). The at least one processor of the central server, central controller, or remote host is configured to execute the events, messages, or commands represented by such data or signals in conjunction with the operation of the central server, central controller, or remote host. One, more than one, or each of the functions of the central server, central controller, or remote host may be performed by the at least one processor of the EGM (or personal computing device). Further, one, more than one, or each of the functions of the at least one processor of the EGM (or personal computing device) may be performed by the at least one processor of the central server, central controller, or remote host.

In certain such embodiments, computerized instructions for controlling any games (such as any primary or base games and/or any secondary or bonus games) displayed by the EGM (or personal computing device) are executed by the central server, central controller, or remote host. In such "thin client" embodiments, the central server, central controller, or remote host remotely controls any games (or other suitable interfaces) displayed by the EGM (or personal computing device), and the EGM (or personal computing device) is utilized to display such games (or suitable interfaces) and to receive one or more inputs or commands. In other such embodiments, computerized instructions for controlling any games displayed by the EGM (or personal computing device) are communicated from the central server, central controller, or remote host to the EGM (or personal computing device) and are stored in at least one memory device of the EGM (or personal computing device). In such "thick client" embodiments, the at least one processor of the EGM (or personal computing device) executes the computerized instructions to control any games (or other suitable interfaces) displayed by the EGM (or personal computing device).

In various embodiments in which the gaming system includes a plurality of EGMs (or personal computing devices), one or more of the EGMs (or personal computing devices) are thin client EGMs (or personal computing devices) and one or more of the EGMs (or personal computing devices) are thick client EGMs (or personal computing devices). In other embodiments in which the gaming system includes one or more EGMs (or personal computing devices), certain functions of one or more of the EGMs (or personal computing devices) are implemented in a thin client environment, and certain other functions of one or more of the EGMs (or personal computing devices) are implemented in a thick client environment. In one such embodiment in which the gaming system includes an EGM (or personal computing device) and a central server, central controller, or remote host, computerized instructions for controlling any primary or base games displayed by the EGM (or personal computing device) are communicated from the central server, central controller, or remote host to the EGM (or personal computing device) in a thick client configuration, and computerized instructions for controlling any secondary or bonus games or other functions displayed by the EGM (or personal computing device) are executed by the central server, central controller, or remote host in a thin client configuration.

In certain embodiments in which the gaming system includes: (a) an EGM (or personal computing device) configured to communicate with a central server, central controller, or remote host through a data network; and/or (b) a plurality of EGMs (or personal computing devices) configured to communicate with one another through a data network, the data network is a local area network (LAN) in which the EGMs (or personal computing devices) are located substantially proximate to one another and/or the central server, central controller, or remote host. In one example, the EGMs (or personal computing devices) and the central server, central controller, or remote host are located in a gaming establishment or a portion of a gaming establishment.

In other embodiments in which the gaming system includes: (a) an EGM (or personal computing device) configured to communicate with a central server, central controller, or remote host through a data network; and/or (b) a plurality of EGMs (or personal computing devices) configured to communicate with one another through a data network, the data network is a wide area network (WAN) in which one or more of the EGMs (or personal computing devices) are not necessarily located substantially proximate to another one of the EGMs (or personal computing devices) and/or the central server, central controller, or remote host. For example, one or more of the EGMs (or personal computing devices) are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs (or personal computing devices) are located. In certain embodiments in which the data network is a WAN, the gaming system includes a central server, central controller, or remote host and an EGM (or personal computing device) each located in a different gaming establishment in a same geographic area, such as a same city or a same state. Gaming systems in which the data network is a WAN are substantially identical to gaming systems in which the data network is a LAN, though the quantity of EGMs (or personal computing devices) in such gaming systems may vary relative to one another.

In further embodiments in which the gaming system includes: (a) an EGM (or personal computing device) configured to communicate with a central server, central controller, or remote host through a data network; and/or (b) a plurality of EGMs (or personal computing devices) configured to communicate with one another through a data network, the data network is an internet (such as the Internet) or an intranet. In certain such embodiments, an Internet browser of the EGM (or personal computing device) is usable to access an Internet game page from any location where an Internet connection is available. In one such embodiment, after the EGM (or personal computing device) accesses the Internet game page, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. The central server, central controller, or remote host may, however, identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM (or personal computing device), such as by identifying the MAC address or the IP address of the Internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the Internet browser of the EGM (or personal computing device). Examples of implementations of Internet-based gaming are further described in U.S. Pat. No. 8,764,566, entitled "Internet Remote Game Server," and U.S. Pat. No. 8,147,334, entitled "Universal Game Server," which are incorporated herein by reference.

The central server, central controller, or remote host and the EGM (or personal computing device) are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile Internet network), or any other suitable medium. The expansion in the quantity of computing devices and the quantity and speed of Internet connections in recent years increases opportunities for players to use a variety of EGMs (or personal computing devices) to play games from an ever-increasing quantity of remote sites. Additionally, the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 4:
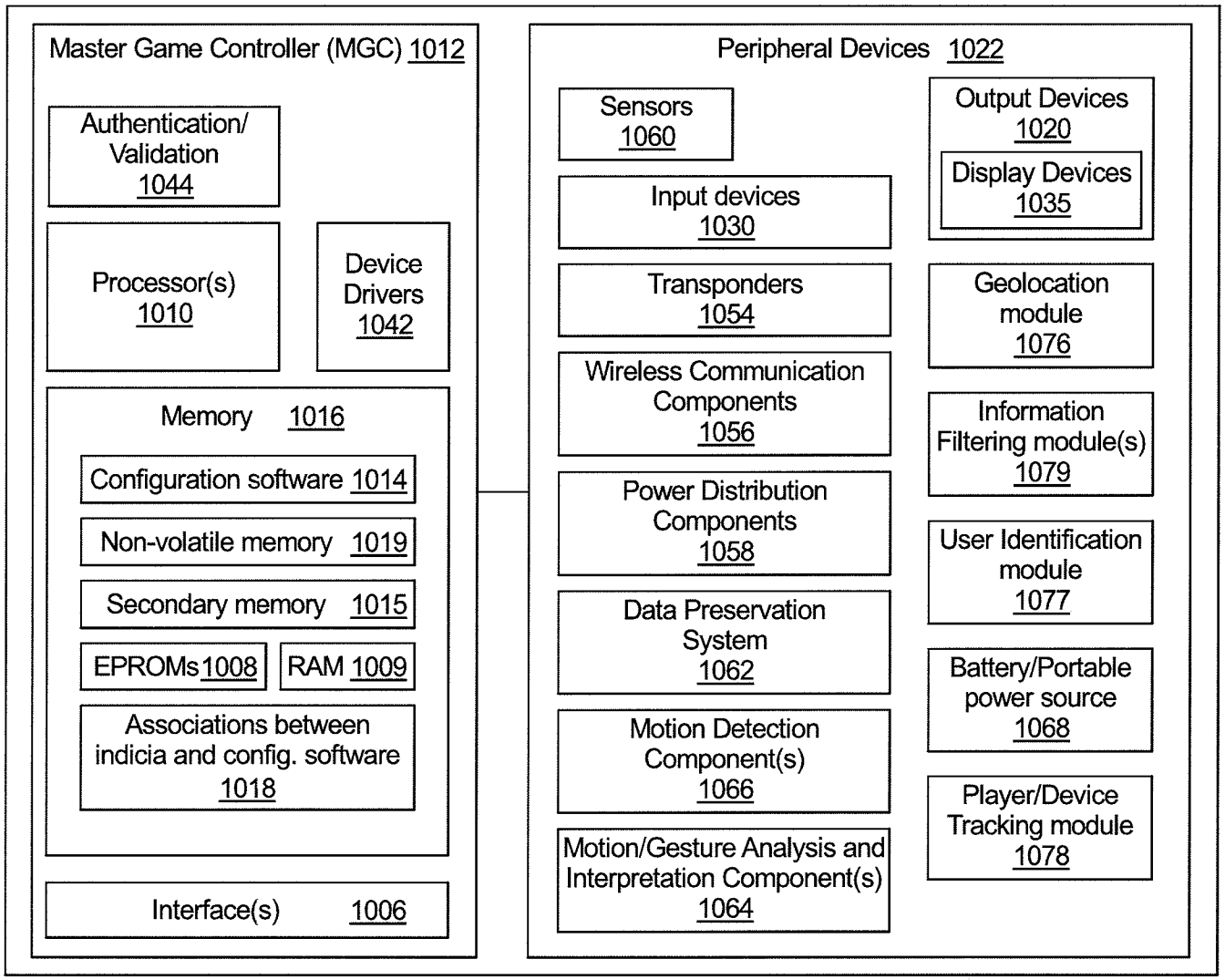
FIG. 4 is a schematic block diagram of one embodiment of an electronic configuration of an example gaming system disclosed herein.
Figure 5A:
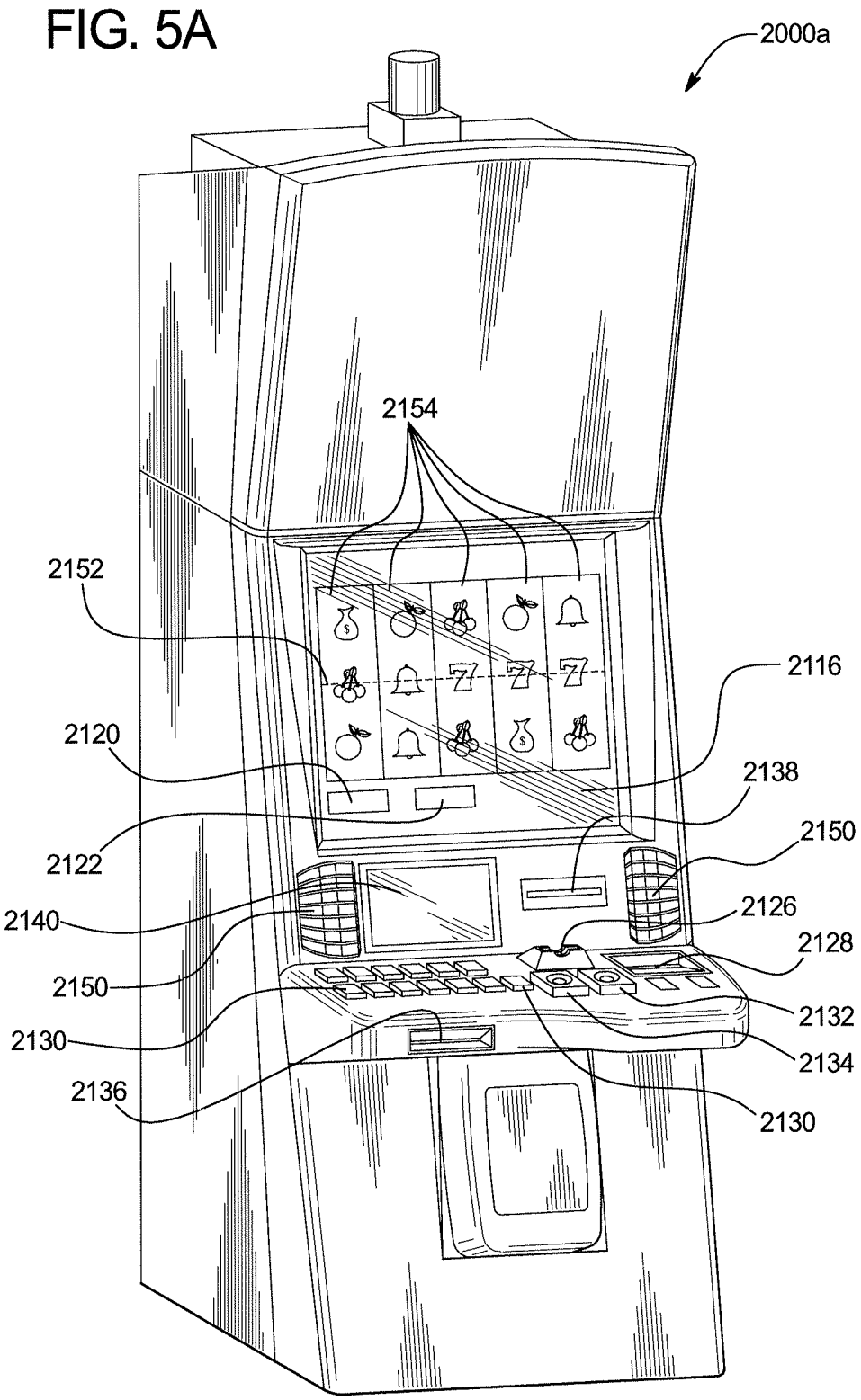
FIGS. 5A and 5B are perspective views of example alternative embodiments of the gaming system disclosed herein.
Figure 5B:
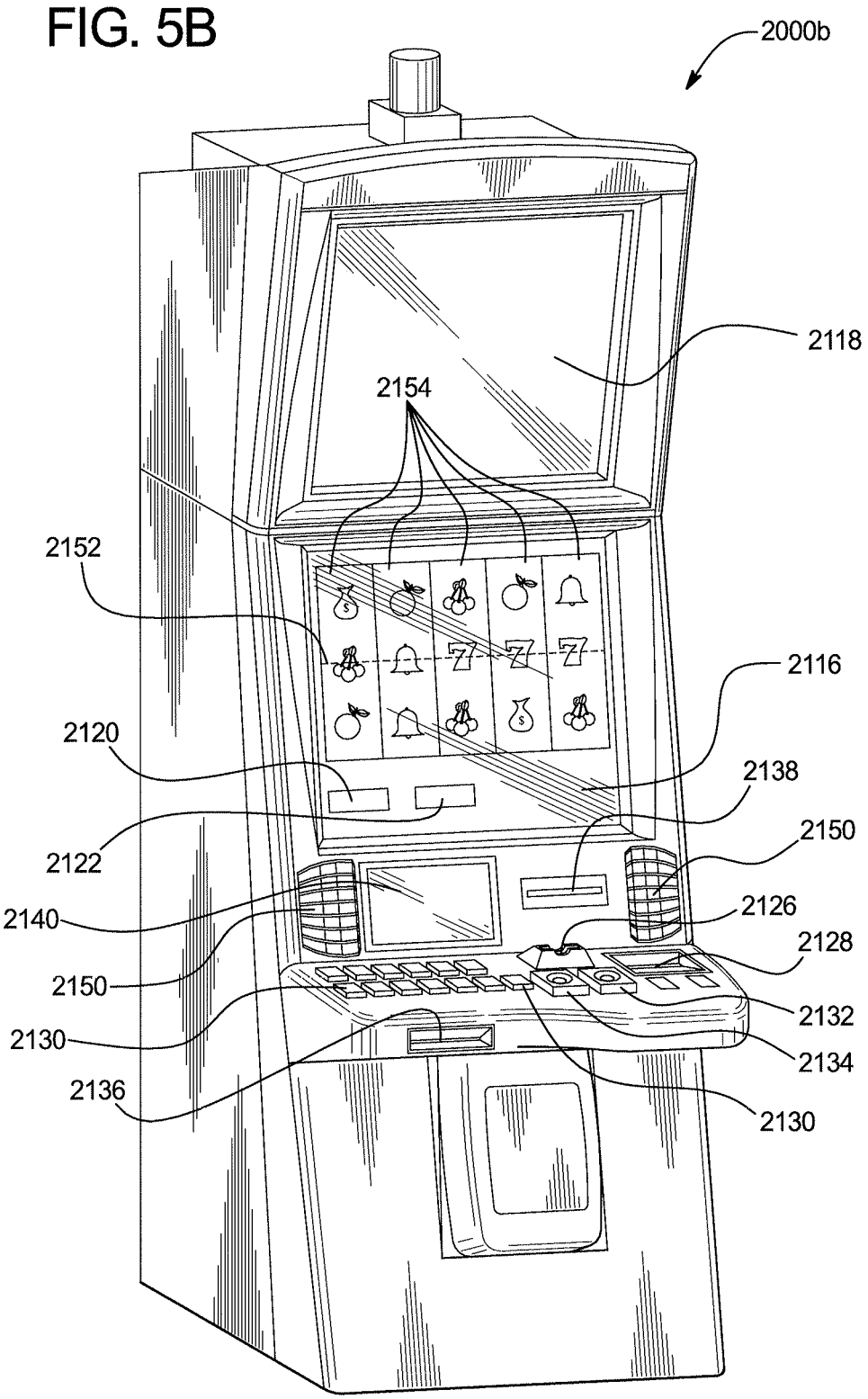

FIG. 4 is a block diagram of an example EGM 1000 and FIGS. 5A and 5B include two different example EGMs 2000*a* and 2000*b*. The EGMs 1000, 2000*a*, and 2000*b* are merely example EGMs, and different EGMs may be implemented using different combinations of the components shown in the EGMs 1000, 2000*a*, and 2000*b*.

In these embodiments, the EGM 1000 includes a master gaming controller 1012 configured to communicate with and to operate with a plurality of peripheral devices 1022.

The master gaming controller 1012 includes at least one processor 1010. The at least one processor 1010 is any suitable processing device or set of processing devices, such as a microprocessor, a microcontroller-based platform, a suitable integrated circuit, or one or more application-specific integrated circuits (ASICs), configured to execute software enabling various configuration and reconfiguration tasks, such as: (1) communicating with a remote source (such as a server that stores authentication information or game information) via a communication interface 1006 of the master gaming controller 1012; (2) converting signals read by an interface to a format corresponding to that used by software or memory of the EGM; (3) accessing memory to configure or reconfigure game parameters in the memory according to indicia read from the EGM; (4) communicating with interfaces and the peripheral devices 1022 (such as input/output devices); and/or (5) controlling the peripheral devices 1022. In certain embodiments, one or more components of the master gaming controller 1012 (such as the at least one processor 1010) reside within a housing of the EGM (described below), while in other embodiments at least one component of the master gaming controller 1012 resides outside of the housing of the EGM.

The master gaming controller 1012 also includes at least one memory device 1016, which includes: (1) volatile memory (e.g., RAM 1009, which can include non-volatile RAM, magnetic RAM, ferroelectric RAM, and any other suitable forms); (2) non-volatile memory 1019 (e.g., disk memory, FLASH memory, EPROMs, EEPROMs, memristor-based non-volatile solid-state memory, etc.); (3) unalterable memory (e.g., EPROMs 1008); (4) read-only memory; and/or (5) a secondary memory storage device 1015, such as a non-volatile memory device, configured to store gaming software related information (the gaming software related information and the memory may be used to store various audio files and games not currently being used and invoked in a configuration or reconfiguration). Any other suitable magnetic, optical, and/or semiconductor memory may operate in conjunction with the EGM disclosed herein. In certain embodiments, the at least one memory device 1016 resides within the housing of the EGM (described below), while in other embodiments at least one component of the at least one memory device 1016 resides outside of the housing of the EGM.

The at least one memory device 1016 is configured to store, for example: (1) configuration software 1014, such as all the parameters and settings for a game playable on the EGM; (2) associations 1018 between configuration indicia read from an EGM with one or more parameters and settings; (3) communication protocols configured to enable the at least one processor 1010 to communicate with the peripheral devices 1022; and/or (4) communication transport protocols (such as TCP/IP, USB, Firewire, IEEE1394, Bluetooth, IEEE 802.11x (IEEE 802.11 standards), hiperlan/2, HomeRF, etc.) configured to enable the EGM to communicate with local and non-local devices using such protocols. In one implementation, the master gaming controller 1012 communicates with other devices using a serial communication protocol. A few non-limiting examples of serial communication protocols that other devices, such as peripherals (e.g., a bill validator or a ticket printer), may use to communicate with the master game controller 1012 include USB, RS-232, and Netplex (a proprietary protocol developed by IGT).

In certain embodiments, the at least one memory device 1016 is configured to store program code and instructions executable by the at least one processor of the EGM to control the EGM. The at least one memory device 1016 of the EGM also stores other operating data, such as image data, event data, input data, random number generators (RNGs) or pseudo-RNGs, paytable data or information, and/or applicable game rules that relate to the play of one or more games on the EGM. In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an Internet or intranet).

The at least one memory device 1016 also stores a plurality of device drivers 1042. Examples of different types of device drivers include device drivers for EGM components and device drivers for the peripheral components 1022. Typically, the device drivers 1042 utilize various communication protocols that enable communication with a particular physical device. The device driver abstracts the hardware implementation of that device. For example, a device driver may be written for each type of card reader that could potentially be connected to the EGM. Non-limiting examples of communication protocols used to implement the device drivers include Netplex, USB, Serial, Ethernet 175, Firewire, I/O debouncer, direct memory map, serial, PCI, parallel, RF, Bluetooth™, near-field communications (e.g., using near-field magnetics), 802.11 (WiFi), etc. In one embodiment, when one type of a particular device is exchanged for another type of the particular device, the at least one processor of the EGM loads the new device driver from the at least one memory device to enable communication with the new device. For instance, one type of card reader in the EGM can be replaced with a second different type of card reader when device drivers for both card readers are stored in the at least one memory device.

In certain embodiments, the software units stored in the at least one memory device 1016 can be upgraded as needed. For instance, when the at least one memory device 1016 is a hard drive, new games, new game options, new parameters, new settings for existing parameters, new settings for new parameters, new device drivers, and new communication protocols can be uploaded to the at least one memory device 1016 from the master game controller 1012 or from some other external device. As another example, when the at least one memory device 1016 includes a CD/DVD drive including a CD/DVD configured to store game options, parameters, and settings, the software stored in the at least one memory device 1016 can be upgraded by replacing a first CD/DVD with a second CD/DVD. In yet another example, when the at least one memory device 1016 uses flash memory 1019 or EPROM 1008 units configured to store games, game options, parameters, and settings, the software stored in the flash and/or EPROM memory units can be upgraded by replacing one or more memory units with new memory units that include the upgraded software. In another embodiment, one or more of the memory devices, such as the hard drive, may be employed in a game software download process from a remote software server.

In some embodiments, the at least one memory device 1016 also stores authentication and/or validation components 1044 configured to authenticate/validate specified EGM components and/or information, such as hardware components, software components, firmware components, peripheral device components, user input device components, information received from one or more user input devices, information stored in the at least one memory device 1016, etc. Examples of various authentication and/or validation components are described in U.S. Pat. No. 6,620,047, entitled "Electronic Gaming Apparatus Having Authentication Data Sets," which is incorporated herein by reference.

In certain embodiments, the peripheral devices 1022 include several device interfaces, such as: (1) at least one output device 1020 including at least one display device 1035; (2) at least one input device 1030 (which may include contact and/or non-contact interfaces); (3) at least one transponder 1054; (4) at least one wireless communication component 1056; (5) at least one wired/wireless power distribution component 1058; (6) at least one sensor 1060; (7) at least one data preservation component 1062; (8) at least one motion/gesture analysis and interpretation component 1064; (9) at least one motion detection component 1066; (10) at least one portable power source 1068; (11) at least one geolocation module 1076; (12) at least one user identification module 1077; (13) at least one player/device tracking module 1078; and (14) at least one information filtering module 1079.

The at least one output device 1020 includes at least one display device 1035 configured to display any game(s) displayed by the EGM and any suitable information associated with such game(s). In certain embodiments, the display devices are connected to or mounted on a housing of the EGM (described below). In various embodiments, the display devices serve as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM 2000*a* illustrated in FIG. 5A includes a central display device 2116, a player tracking display 2140, a credit display 2120, and a bet display 2122. The example EGM 2000*b* illustrated in FIG. 5B includes a central display device 2116, an upper display device 2118, a player tracking display 2140, a credit display 2120, and a bet display 2122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. The display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, the at least one output device 1020 includes a payout device. In these embodiments, after the EGM receives an actuation of a cashout device (described below), the EGM causes the payout device to provide a payment to the player. In one embodiment, the payout device is one or more of: (a) a ticket printer and dispenser configured to print and dispense a ticket or credit slip associated with a monetary value, wherein the ticket or credit slip may be redeemed for its monetary value via a cashier, a kiosk, or other suitable redemption system; (b) a bill dispenser configured to dispense paper currency; (c) a coin dispenser configured to dispense coins or tokens (such as into a coin payout tray); and (d) any suitable combination thereof. The example EGMs 2000*a* and 2000*b* illustrated in FIGS. 5A and 5B each include a ticket printer and dispenser 2136. Examples of ticket-in ticket-out (TITO) technology are described in U.S. Pat. No. 5,429,361, entitled "Gaming Machine Information, Communication and Display System"; U.S. Pat. No. 5,470,079, entitled "Gaming Machine Accounting and Monitoring System"; U.S. Pat. No. 5,265,874, entitled "Cashless Gaming Apparatus and Method"; U.S. Pat. No. 6,729,957, entitled "Gaming Method and Host Computer with Ticket-In/Ticket-Out Capability"; U.S. Pat. No. 6,729,958, entitled "Gaming System with Ticket-In/Ticket-Out Capability"; U.S. Pat. No. 6,736,725, entitled "Gaming Method and Host Computer with Ticket-In/Ticket-Out Capability"; U.S. Pat. No. 7,275,991, entitled "Slot Machine with Ticket-In/Ticket-Out Capability"; U.S. Pat. No. 6,048,269, entitled "Coinless Slot Machine System and Method"; and U.S. Pat. No. 5,290,003, entitled "Gaming Machine and Coupons," which are incorporated herein by reference.

In certain embodiments, rather than dispensing bills, coins, or a physical ticket having a monetary value to the player following receipt of an actuation of the cashout device, the payout device is configured to cause a payment to be provided to the player in the form of an electronic funds transfer, such as via a direct deposit into a bank account, a casino account, or a prepaid account of the player; via a transfer of funds onto an electronically recordable identification card or smart card of the player; or via sending a virtual ticket having a monetary value to an electronic device of the player. Examples of providing payment using virtual tickets are described in U.S. Pat. No. 8,613,659, entitled "Virtual Ticket-In and Ticket-Out on a Gaming Machine," which is incorporated herein by reference.

While any credit balances, any wagers, any values, and any awards are described herein as amounts of monetary credits or currency, one or more of such credit balances, such wagers, such values, and such awards may be for non-monetary credits, promotional credits, of player tracking points or credits.

In certain embodiments, the at least one output device 1020 is a sound generating device controlled by one or more sound cards. In one such embodiment, the sound generating device includes one or more speakers or other sound generating hardware and/or software configured to generate sounds, such as by playing music for any games or by playing music for other modes of the EGM, such as an attract mode. The example EGMs 2000*a* and 2000*b* illustrated in FIGS. 5A and 5B each include a plurality of speakers 2150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

The at least one input device 1030 may include any suitable device that enables an input signal to be produced and received by the at least one processor 1010 of the EGM.

In one embodiment, the at least one input device 1030 includes a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. The example EGMs 2000*a* and 2000*b* illustrates in FIGS. 5A and 5B each include a combined bill and ticket acceptor 2128 and a coin slot 2126.

In one embodiment, the at least one input device 1030 includes a payment device configured to enable the EGM to be funded via an electronic funds transfer, such as a transfer of funds from a bank account. In another embodiment, the EGM includes a payment device configured to communicate with a mobile device of a player, such as a mobile phone, a radio frequency identification tag, or any other suitable wired or wireless device, to retrieve relevant information associated with that player to fund the EGM. Examples of funding an EGM via communication between the EGM and a mobile device (such as a mobile phone) of a player are described in U.S. Patent Application Publication No. 2013/0344942, entitled "Avatar as Security Measure for Mobile Device Use with Electronic Gaming Machine," which is incorporated herein by reference. When the EGM is funded, the at least one processor determines the amount of funds entered and displays the corresponding amount on a credit display or any other suitable display as described below.

In certain embodiments, the at least one input device 1030 includes at least one wagering or betting device. In various embodiments, the one or more wagering or betting devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). One such wagering or betting device is as a maximum wager or bet device that, when actuated, causes the EGM to place a maximum wager on a play of a game. Another such wagering or betting device is a repeat bet device that, when actuated, causes the EGM to place a wager that is equal to the previously-placed wager on a play of a game. A further such wagering or betting device is a bet one device that, when actuated, causes the EGM to increase the wager by one credit. Generally, upon actuation of one of the wagering or betting devices, the quantity of credits displayed in a credit meter (described below) decreases by the amount of credits wagered, while the quantity of credits displayed in a bet display (described below) increases by the amount of credits wagered.

In various embodiments, the at least one input device 1030 includes at least one game play activation device. In various embodiments, the one or more game play initiation devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). After a player appropriately funds the EGM and places a wager, the EGM activates the game play activation device to enable the player to actuate the game play activation device to initiate a play of a game on the EGM (or another suitable sequence of events associated with the EGM). After the EGM receives an actuation of the game play activation device, the EGM initiates the play of the game. The example EGMs 2000*a* and 2000*b* illustrated in FIGS. 5A and 5B each include a game play activation device in the form of a game play initiation button 2132. In other embodiments, the EGM begins game play automatically upon appropriate funding rather than upon utilization of the game play activation device.

In other embodiments, the at least one input device 1030 includes a cashout device. In various embodiments, the cashout device is: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). When the EGM receives an actuation of the cashout device from a player and the player has a positive (i.e., greater-than-zero) credit balance, the EGM initiates a payout associated with the player's credit balance. The example EGMs 2000*a* and 2000*b* illustrated in FIGS. 5A and 5B each include a cashout device in the form of a cashout button 2134.

In various embodiments, the at least one input device 1030 includes a plurality of buttons that are programmable by the EGM operator to, when actuated, cause the EGM to perform particular functions. For instance, such buttons may be hard keys, programmable soft keys, or icons icon displayed on a display device of the EGM (described below) that are actuatable via a touch screen of the EGM (described below) or via use of a suitable input device of the EGM (such as a mouse or a joystick). The example EGMs 2000*a* and 2000*b* illustrated in FIGS. 5A and 5B each include a plurality of such buttons 2130.

In certain embodiments, the at least one input device 1030 includes a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In embodiments including a player tracking system, as further described below, the at least one input device 1030 includes a card reader in communication with the at least one processor of the EGM. The example EGMs 2000*a* and 2000*b* illustrated in FIGS. 5A and 5B each include a card reader 2138. The card reader is configured to read a player identification card inserted into the card reader.

The at least one wireless communication component 1056 includes one or more communication interfaces having different architectures and utilizing a variety of protocols, such as (but not limited to) 802.11 (WiFi); 802.15 (including Bluetooth™); 802.16 (WiMax); 802.22; cellular standards such as CDMA, CDMA2000, and WCDMA; Radio Frequency (e.g., RFID); infrared; and Near Field Magnetic communication protocols. The at least one wireless communication component 1056 transmits electrical, electromagnetic, or optical signals that carry digital data streams or analog signals representing various types of information.

The at least one wired/wireless power distribution component 1058 includes components or devices that are configured to provide power to other devices. For example, in one embodiment, the at least one power distribution component 1058 includes a magnetic induction system that is configured to provide wireless power to one or more user input devices near the EGM. In one embodiment, a user input device docking region is provided, and includes a power distribution component that is configured to recharge a user input device without requiring metal-to-metal contact. In one embodiment, the at least one power distribution component 1058 is configured to distribute power to one or more internal components of the EGM, such as one or more rechargeable power sources (e.g., rechargeable batteries) located at the EGM.

In certain embodiments, the at least one sensor 1060 includes at least one of: optical sensors, pressure sensors, RF sensors, infrared sensors, image sensors, thermal sensors, and biometric sensors. The at least one sensor 1060 may be used for a variety of functions, such as: detecting movements and/or gestures of various objects within a predetermined proximity to the EGM; detecting the presence and/or identity of various persons (e.g., players, casino employees, etc.), devices (e.g., user input devices), and/or systems within a predetermined proximity to the EGM.

The at least one data preservation component 1062 is configured to detect or sense one or more events and/or conditions that, for example, may result in damage to the EGM and/or that may result in loss of information associated with the EGM. Additionally, the data preservation system 1062 may be operable to initiate one or more appropriate action(s) in response to the detection of such events/conditions.

The at least one motion/gesture analysis and interpretation component 1064 is configured to analyze and/or interpret information relating to detected player movements and/or gestures to determine appropriate player input information relating to the detected player movements and/or gestures. For example, in one embodiment, the at least one motion/gesture analysis and interpretation component 1064 is configured to perform one or more of the following functions: analyze the detected gross motion or gestures of a player; interpret the player's motion or gestures (e.g., in the context of a casino game being played) to identify instructions or input from the player; utilize the interpreted instructions/input to advance the game state; etc. In other embodiments, at least a portion of these additional functions may be implemented at a remote system or device.

The at least one portable power source 1068 enables the EGM to operate in a mobile environment. For example, in one embodiment, the EGM 300 includes one or more rechargeable batteries.

The at least one geolocation module 1076 is configured to acquire geolocation information from one or more remote sources and use the acquired geolocation information to determine information relating to a relative and/or absolute position of the EGM. For example, in one implementation, the at least one geolocation module 1076 is configured to receive GPS signal information for use in determining the position or location of the EGM. In another implementation, the at least one geolocation module 1076 is configured to receive multiple wireless signals from multiple remote devices (e.g., EGMs, servers, wireless access points, etc.) and use the signal information to compute position/location information relating to the position or location of the EGM.

The at least one user identification module 1077 is configured to determine the identity of the current user or current owner of the EGM. For example, in one embodiment, the current user is required to perform a login process at the EGM in order to access one or more features. Alternatively, the EGM is configured to automatically determine the identity of the current user based on one or more external signals, such as an RFID tag or badge worn by the current user and that provides a wireless signal to the EGM that is used to determine the identity of the current user. In at least one embodiment, various security features are incorporated into the EGM to prevent unauthorized users from accessing confidential or sensitive information.

The at least one information filtering module 1079 is configured to perform filtering (e.g., based on specified criteria) of selected information to be displayed at one or more displays 1035 of the EGM.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. U.S. Pat. No. 7,290,072 describes a variety of EGMs including one or more communication ports that enable the EGMs to communicate and operate with one or more external peripherals.

As generally described above, in certain embodiments, such as the example EGMs 2000*a* and 2000*b* illustrated in FIGS. 5A and 5B, the EGM has a support structure, housing, or cabinet that provides support for a plurality of the input devices and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs 2000*a* and 2000*b* shown in FIGS. 5A and 5B, EGMs may have varying housing and display configurations.

In certain embodiments, the EGM is a device that has obtained approval from a regulatory gaming commission, and in other embodiments, the EGM is a device that has not obtained approval from a regulatory gaming commission.

The EGMs described above are merely three examples of different types of EGMs. Certain of these example EGMs may include one or more elements that may not be included in all gaming systems, and these example EGMs may not include one or more elements that are included in other gaming systems. For example, certain EGMs include a coin acceptor while others do not.

Operation of Primary or Base Games and/or Secondary or Bonus Games

In various embodiments, an EGM may be implemented in one of a variety of different configurations. In various embodiments, the EGM may be implemented as one of: (a) a dedicated EGM in which computerized game programs executable by the EGM for controlling any primary or base games (referred to herein as "primary games") and/or any secondary or bonus games or other functions displayed by the EGM are provided with the EGM prior to delivery to a gaming establishment or prior to being provided to a player; and (b) a changeable EGM in which computerized game programs executable by the EGM for controlling any primary games and/or secondary games displayed by the EGM are downloadable or otherwise transferred to the EGM through a data network or remote communication link; from a USB drive, flash memory card, or other suitable memory device; or in any other suitable manner after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. Examples of this type of award evaluation are described in U.S. Pat. No. 7,470,183, entitled "Finite Pool Gaming Method and Apparatus"; U.S. Pat. No. 7,563,163, entitled "Gaming Device Including Outcome Pools for Providing Game Outcomes"; U.S. Pat. No. 7,833,092, entitled "Method and System for Compensating for Player Choice in a Game of Chance"; U.S. Pat. No. 8,070,579, entitled "Bingo System with Downloadable Common Patterns"; and U.S. Pat. No. 8,398,472, entitled "Central Determination Poker Game," which are incorporated herein by reference.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. Examples of this type of award determination are described in U.S. Pat. No. 7,753,774, entitled "Using Multiple Bingo Cards to Represent Multiple Slot Paylines and Other Class III Game Options"; U.S. Pat. No. 7,731,581, entitled "Multi-Player Bingo Game with Multiple Alternative Outcome Displays"; U.S. Pat. No. 7,955,170, entitled "Providing Non-Bingo Outcomes for a Bingo Game"; U.S. Pat. No. 8,070,579, entitled "Bingo System with Downloadable Common Patterns"; and U.S. Pat. No. 8,500,538, entitled "Bingo Gaming System and Method for Providing Multiple Outcomes from Single Bingo Pattern," which are incorporated herein by reference.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database configured to store player profiles, (b) a player tracking module configured to track players (as described below), and (c) a credit system configured to provide automated transactions. Examples of such accounting systems are described in U.S. Pat. No. 6,913,534, entitled "Gaming Machine Having a Lottery Game and Capability for Integration with Gaming Device Accounting System and Player Tracking System," and U.S. Pat. No. 8,597,116, entitled "Virtual Player Tracking and Related Services," which are incorporated herein by reference.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGM 2000*b* shown in FIG. 5B includes a payline 1152 and a plurality of reels 1154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. Examples of ways to win award determinations are described in U.S. Pat. No. 8,012,011, entitled "Gaming Device and Method Having Independent Reels and Multiple Ways of Winning"; U.S. Pat. No. 8,241,104, entitled "Gaming Device and Method Having Designated Rules for Determining Ways To Win"; and U.S. Pat. No. 8,430,739, entitled "Gaming System and Method Having Wager Dependent Different Symbol Evaluations," which are incorporated herein by reference.

As generally noted above, in addition to providing winning credits or other awards for one or more plays of the primary game(s), in various embodiments the gaming system provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). The secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. Any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for providing the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. Examples of group gaming systems are described in U.S. Pat. No. 8,070,583, entitled "Server Based Gaming System and Method for Selectively Providing One or More Different Tournaments"; U.S. Pat. No. 8,500,548, entitled "Gaming System and Method for Providing Team Progressive Awards"; and U.S. Pat. No. 8,562,423, entitled "Method and Apparatus for Rewarding Multiple Game Players for a Single Win," which are incorporated herein by reference.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a mobile phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. Examples of player tracking systems are described in U.S. Pat. No. 6,722,985, entitled "Universal Player Tracking System"; U.S. Pat. No. 6,908,387, entitled "Player Tracking Communication Mechanisms in a Gaming Machine"; U.S. Pat. No. 7,311,605, entitled "Player Tracking Assembly for Complete Patron Tracking for Both Gaming and Non-Gaming Casino Activity"; U.S. Pat. No. 7,611,411, entitled "Player Tracking Instruments Having Multiple Communication Modes"; U.S. Pat. No. 7,617,151, entitled "Alternative Player Tracking Techniques"; and U.S. Pat. No. 8,057,298, entitled "Virtual Player Tracking and Related Services," which are incorporated herein by reference.

Differentiating Certain Gaming Systems from General Purpose Computing Devices Certain of the gaming systems described herein, such as EGMs located in a casino or another gaming establishment, include certain components and/or are configured to operate in certain manners that differentiate these systems from general purpose computing devices, i.e., certain personal gaming devices such as desktop computers and laptop computers.

For instance, EGMs are highly regulated to ensure fairness and, in many cases, EGMs are configured to award monetary awards up to multiple millions of dollars. To satisfy security and regulatory requirements in a gaming environment, hardware and/or software architectures are implemented in EGMs that differ significantly from those of general purpose computing devices. For purposes of illustration, a description of EGMs relative to general purpose computing devices and some examples of these additional (or different) hardware and/or software architectures found in EGMs are described below.

At first glance, one might think that adapting general purpose computing device technologies to the gaming industry and EGMs would be a simple proposition because both general purpose computing devices and EGMs employ processors that control a variety of devices. However, due to at least: (1) the regulatory requirements placed on EGMs, (2) the harsh environment in which EGMs operate, (3) security requirements, and (4) fault tolerance requirements, adapting general purpose computing device technologies to EGMs can be quite difficult. Further, techniques and methods for solving a problem in the general purpose computing device industry, such as device compatibility and connectivity issues, might not be adequate in the gaming industry. For instance, a fault or a weakness tolerated in a general purpose computing device, such as security holes in software or frequent crashes, is not tolerated in an EGM because in an EGM these faults can lead to a direct loss of funds from the EGM, such as stolen cash or loss of revenue when the EGM is not operating properly or when the random outcome determination is manipulated.

Certain differences between general purpose computing devices and EGMs are described below. A first difference between EGMs and general purpose computing devices is that EGMs are state-based systems. A state-based system stores and maintains its current state in a non-volatile memory such that, in the event of a power failure or other malfunction, the state-based system can return to that state when the power is restored or the malfunction is remedied. For instance, for a state-based EGM, if the EGM displays an award for a game of chance but the power to the EGM fails before the EGM provides the award to the player, the EGM stores the pre-power failure state in a non-volatile memory, returns to that state upon restoration of power, and provides the award to the player. This requirement affects the software and hardware design on EGMs. General purpose computing devices are not state-based machines, and a majority of data is usually lost when a malfunction occurs on a general purpose computing device.

A second difference between EGMs and general purpose computing devices is that, for regulatory purposes, the software on the EGM utilized to operate the EGM has been designed to be static and monolithic to prevent cheating by the operator of the EGM. For instance, one solution that has been employed in the gaming industry to prevent cheating and to satisfy regulatory requirements has been to manufacture an EGM that can use a proprietary processor running instructions to provide the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used to operate a device during generation of the game of chance, can require burning a new EPROM approved by the gaming jurisdiction and reinstalling the new EPROM on the EGM in the presence of a gaming regulator. Regardless of whether the EPROM solution is used, to gain approval in most gaming jurisdictions, an EGM must demonstrate sufficient safeguards that prevent an operator or a player of an EGM from manipulating the EGM's hardware and software in a manner that gives him an unfair, and in some cases illegal, advantage.

A third difference between EGMs and general purpose computing devices is authentication—EGMs storing code are configured to authenticate the code to determine if the code is unaltered before executing the code. If the code has been altered, the EGM prevents the code from being executed. The code authentication requirements in the gaming industry affect both hardware and software designs on EGMs. Certain EGMs use hash functions to authenticate code. For instance, one EGM stores game program code, a hash function, and an authentication hash (which may be encrypted). Before executing the game program code, the EGM hashes the game program code using the hash function to obtain a result hash and compares the result hash to the authentication hash. If the result hash matches the authentication hash, the EGM determines that the game program code is valid and executes the game program code. If the result hash does not match the authentication hash, the EGM determines that the game program code has been altered (i.e., may have been tampered with) and prevents execution of the game program code. Examples of EGM code authentication are described in U.S. Pat. No. 6,962,530, entitled "Authentication in a Secure Computerized Gaming System"; U.S. Pat. No. 7,043,641, entitled "Encryption in a Secure Computerized Gaming System"; U.S. Pat. No. 7,201,662, entitled "Method and Apparatus for Software Authentication"; and U.S. Pat. No. 8,627,097, entitled "System and Method Enabling Parallel Processing of Hash Functions Using Authentication Checkpoint Hashes," which are incorporated herein by reference.

A fourth difference between EGMs and general purpose computing devices is that EGMs have unique peripheral device requirements that differ from those of a general purpose computing device, such as peripheral device security requirements not usually addressed by general purpose computing devices. For instance, monetary devices, such as coin dispensers, bill validators, and ticket printers and computing devices that are used to govern the input and output of cash or other items having monetary value (such as tickets) to and from an EGM have security requirements that are not typically addressed in general purpose computing devices. Therefore, many general purpose computing device techniques and methods developed to facilitate device connectivity and device compatibility do not address the emphasis placed on security in the gaming industry.

To address some of the issues described above, a number of hardware/software components and architectures are utilized in EGMs that are not typically found in general purpose computing devices. These hardware/software components and architectures, as described below in more detail, include but are not limited to watchdog timers, voltage monitoring systems, state-based software architecture and supporting hardware, specialized communication interfaces, security monitoring, and trusted memory.

Certain EGMs use a watchdog timer to provide a software failure detection mechanism. In a normally-operating EGM, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits include a loadable timeout counter register to enable the operating software to set the timeout interval within a certain range of time. A differentiating feature of some circuits is that the operating software cannot completely disable the function of the watchdog timer. In other words, the watchdog timer always functions from the time power is applied to the board.

Certain EGMs use several power supply voltages to operate portions of the computer circuitry. These can be generated in a central power supply or locally on the computer board. If any of these voltages falls out of the tolerance limits of the circuitry they power, unpredictable operation of the EGM may result. Though most modern general purpose computing devices include voltage monitoring circuitry, these types of circuits only report voltage status to the operating software. Out of tolerance voltages can cause software malfunction, creating a potential uncontrolled condition in the general purpose computing device. Certain EGMs have power supplies with relatively tighter voltage margins than that required by the operating circuitry. In addition, the voltage monitoring circuitry implemented in certain EGMs typically has two thresholds of control. The first threshold generates a software event that can be detected by the operating software and an error condition then generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the EGM.

As described above, certain EGMs are state-based machines. Different functions of the game provided by the EGM (e.g., bet, play, result, points in the graphical presentation, etc.) may be defined as a state. When the EGM moves a game from one state to another, the EGM stores critical data regarding the game software in a custom non-volatile memory subsystem. This ensures that the player's wager and credits are preserved and to minimize potential disputes in the event of a malfunction on the EGM. In general, the EGM does not advance from a first state to a second state until critical information that enables the first state to be reconstructed has been stored. This feature enables the EGM to recover operation to the current state of play in the event of a malfunction, loss of power, etc. that occurred just prior to the malfunction. In at least one embodiment, the EGM is configured to store such critical information using atomic transactions.

Generally, an atomic operation in computer science refers to a set of operations that can be combined so that they appear to the rest of the system to be a single operation with only two possible outcomes: success or failure. As related to data storage, an atomic transaction may be characterized as series of database operations which either all occur, or all do not occur. A guarantee of atomicity prevents updates to the database occurring only partially, which can result in data corruption.

To ensure the success of atomic transactions relating to critical information to be stored in the EGM memory before a failure event (e.g., malfunction, loss of power, etc.), memory that includes one or more of the following criteria be used: direct memory access capability; data read/write capability which meets or exceeds minimum read/write access characteristics (such as at least 5.08 Mbytes/sec (Read) and/or at least 38.0 Mbytes/sec (Write)). Memory devices that meet or exceed the above criteria may be referred to as "fault-tolerant" memory devices.

Typically, battery-backed RAM devices may be configured to function as fault-tolerant devices according to the above criteria, whereas flash RAM and/or disk drive memory are typically not configurable to function as fault-tolerant devices according to the above criteria. Accordingly, battery-backed RAM devices are typically used to preserve EGM critical data, although other types of non-volatile memory devices may be employed. These memory devices are typically not used in typical general purpose computing devices.

Thus, in at least one embodiment, the EGM is configured to store critical information in fault-tolerant memory (e.g., battery-backed RAM devices) using atomic transactions. Further, in at least one embodiment, the fault-tolerant memory is able to successfully complete all desired atomic transactions (e.g., relating to the storage of EGM critical information) within a time period of 200 milliseconds or less. In at least one embodiment, the time period of 200 milliseconds represents a maximum amount of time for which sufficient power may be available to the various EGM components after a power outage event has occurred at the EGM.

As described previously, the EGM may not advance from a first state to a second state until critical information that enables the first state to be reconstructed has been atomically stored. After the state of the EGM is restored during the play of a game of chance, game play may resume and the game may be completed in a manner that is no different than if the malfunction had not occurred. Thus, for example, when a malfunction occurs during a game of chance, the EGM may be restored to a state in the game of chance just prior to when the malfunction occurred. The restored state may include metering information and graphical information that was displayed on the EGM in the state prior to the malfunction. For example, when the malfunction occurs during the play of a card game after the cards have been dealt, the EGM may be restored with the cards that were previously displayed as part of the card game. As another example, a bonus game may be triggered during the play of a game of chance in which a player is required to make a number of selections on a video display screen. When a malfunction has occurred after the player has made one or more selections, the EGM may be restored to a state that shows the graphical presentation just prior to the malfunction including an indication of selections that have already been made by the player. In general, the EGM may be restored to any state in a plurality of states that occur in the game of chance that occurs while the game of chance is played or to states that occur between the play of a game of chance.

Game history information regarding previous games played such as an amount wagered, the outcome of the game, and the like may also be stored in a non-volatile memory device. The information stored in the non-volatile memory may be detailed enough to reconstruct a portion of the graphical presentation that was previously presented on the EGM and the state of the EGM (e.g., credits) at the time the game of chance was played. The game history information may be utilized in the event of a dispute. For example, a player may decide that in a previous game of chance that they did not receive credit for an award that they believed they won. The game history information may be used to reconstruct the state of the EGM prior to, during, and/or after the disputed game to demonstrate whether the player was correct or not in her assertion. Examples of a state-based EGM, recovery from malfunctions, and game history are described in U.S. Pat. No. 6,804,763, entitled "High Performance Battery Backed RAM Interface"; U.S. Pat. No. 6,863,608, entitled "Frame Capture of Actual Game Play"; U.S. Pat. No. 7,111,141, entitled "Dynamic NV-RAM"; and U.S. Pat. No. 7,384,339, entitled, "Frame Capture of Actual Game Play," which are incorporated herein by reference.

Another feature of EGMs is that they often include unique interfaces, including serial interfaces, to connect to specific subsystems internal and external to the EGM. The serial devices may have electrical interface requirements that differ from the "standard" EIA serial interfaces provided by general purpose computing devices. These interfaces may include, for example, Fiber Optic Serial, optically coupled serial interfaces, current loop style serial interfaces, etc. In addition, to conserve serial interfaces internally in the EGM, serial devices may be connected in a shared, daisy-chain fashion in which multiple peripheral devices are connected to a single serial channel.

The serial interfaces may be used to transmit information using communication protocols that are unique to the gaming industry. For example, IGT's Netplex is a proprietary communication protocol used for serial communication between EGMs. As another example, SAS is a communication protocol used to transmit information, such as metering information, from an EGM to a remote device. Often SAS is used in conjunction with a player tracking system.

Certain EGMs may alternatively be treated as peripheral devices to a casino communication controller and connected in a shared daisy chain fashion to a single serial interface. In both cases, the peripheral devices are assigned device addresses. If so, the serial controller circuitry must implement a method to generate or detect unique device addresses. General purpose computing device serial ports are not able to do this.

Security monitoring circuits detect intrusion into an EGM by monitoring security switches attached to access doors in the EGM cabinet. Access violations result in suspension of game play and can trigger additional security operations to preserve the current state of game play. These circuits also function when power is off by use of a battery backup. In power-off operation, these circuits continue to monitor the access doors of the EGM. When power is restored, the EGM can determine whether any security violations occurred while power was off, e.g., via software for reading status registers. This can trigger event log entries and further data authentication operations by the EGM software.

Trusted memory devices and/or trusted memory sources are included in an EGM to ensure the authenticity of the software that may be stored on less secure memory subsystems, such as mass storage devices. Trusted memory devices and controlling circuitry are typically designed to not enable modification of the code and data stored in the memory device while the memory device is installed in the EGM. The code and data stored in these devices may include authentication algorithms, random number generators, authentication keys, operating system kernels, etc. The purpose of these trusted memory devices is to provide gaming regulatory authorities a root trusted authority within the computing environment of the EGM that can be tracked and verified as original. This may be accomplished via removal of the trusted memory device from the EGM computer and verification of the secure memory device contents is a separate third party verification device. Once the trusted memory device is verified as authentic, and based on the approval of the verification algorithms included in the trusted device, the EGM is enabled to verify the authenticity of additional code and data that may be located in the gaming computer assembly, such as code and data stored on hard disk drives. Examples of trusted memory devices are described in U.S. Pat. No. 6,685,567, entitled "Process Verification," which is incorporated herein by reference.

In at least one embodiment, at least a portion of the trusted memory devices/sources may correspond to memory that cannot easily be altered (e.g., "unalterable memory") such as EPROMS, PROMS, Bios, Extended Bios, and/or other memory sources that are able to be configured, verified, and/or authenticated (e.g., for authenticity) in a secure and controlled manner.

According to one embodiment, when a trusted information source is in communication with a remote device via a network, the remote device may employ a verification scheme to verify the identity of the trusted information source. For example, the trusted information source and the remote device may exchange information using public and private encryption keys to verify each other's identities. In another embodiment, the remote device and the trusted information source may engage in methods using zero knowledge proofs to authenticate each of their respective identities.

EGMs storing trusted information may utilize apparatuses or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering has been detected. Examples of trusted memory devices/sources are described in U.S. Pat. No. 7,515,718, entitled "Secured Virtual Network in a Gaming Environment," which is incorporated herein by reference.

Mass storage devices used in a general purpose computing devices typically enable code and data to be read from and written to the mass storage device. In a gaming environment, modification of the gaming code stored on a mass storage device is strictly controlled and would only be enabled under specific maintenance type events with electronic and physical enablers required. Though this level of security could be provided by software, EGMs that include mass storage devices include hardware level mass storage data protection circuitry that operates at the circuit level to monitor attempts to modify data on the mass storage device and will generate both software and hardware error triggers should a data modification be attempted without the proper electronic and physical enablers being present. Examples of using a mass storage device are described in U.S. Pat. No. 6,149,522, entitled "Method of Authenticating Game Data Sets in an Electronic Casino Gaming System," which is incorporated herein by reference.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. An electronic gaming machine comprising:

a display device;

a payment acceptor;

a processor; and a memory device which stores a plurality of instructions, which when executed by the processor, cause the processor to:

modify an average expected payback percentage of the electronic gaming machine for a first period of time independent of any modification of the average expected payback percentage of the electronic gaming machine for a second, greater period of time by, for a progressive award:

randomly determining a progressive award reset value from a plurality of different progressive award reset values, wherein at least two of the plurality of different progressive award reset values have different probabilities of being randomly determined, and after randomly determining the progressive award reset value and based on that randomly determined progressive award reset value, randomly determining a progressive award hit value from a range of progressive award hit values comprising a maximum progressive award hit value at one end of the range and the randomly determined progressive award reset value at another end of the range, cause the display device to display:

the randomly determined progressive award reset value as a current value of the progressive award, and the maximum progressive award hit value, simultaneous with the display of the randomly determined progressive award reset value as the current value of the progressive award and the display of the maximum progressive award hit value and responsive to a physical item being received via the payment acceptor, modify a credit balance based, at least in part, on a monetary value associated with the received physical item, wherein the physical item is any of a ticket associated with the monetary value and a unit of currency, and following the modification of the credit balance:

responsive to an occurrence of a progressive award increase event, cause the progressive award to be incremented, and responsive to a progressive award triggering event occurring, increase the credit balance by a currently displayed value of the progressive award, wherein the progressive award triggering event occurs based on the currently displayed value of the progressive award having a predetermined relationship with the randomly determined progressive award hit value.

2. The electronic gaming machine of claim 1, wherein the progressive award reset value is randomly selected from a weighted table of the plurality of different progressive award reset values.

3. The electronic gaming machine of claim 1, wherein the progressive award reset value is at least equal to a progressive award default reset value and less than the randomly determined progressive award hit value.

4. The electronic gaming machine of claim 1, wherein when executed by the processor, the plurality of instructions cause the processor to:

for another progressive award:

randomly determine another progressive award reset value, and after randomly determining the other progressive award reset value and based on that other randomly determined progressive award reset value, randomly determine another progressive award hit value comprising another maximum progressive award hit value, cause the display device to display:

the other randomly determined progressive award reset value as a current value of the other progressive award, and the other maximum progressive award hit value, responsive to the occurrence of the progressive award increase event, cause the other progressive award to be incremented, and responsive to another progressive award triggering event occurring, increase the credit balance by a currently displayed value of the other progressive award, wherein the other progressive award triggering event occurs based on the currently displayed value of the other progressive award having a predetermined relationship with the other randomly determined progressive award hit value.

5. The electronic gaming machine of claim 4, wherein the other progressive award is associated with a different plurality of progressive award reset values from which the other progressive award reset value is randomly determined from, and a different range of progressive award hit values from which the other progressive award hit value is randomly determined from.

6. The electronic gaming machine of claim 1, wherein the progressive award comprises one of a quantity of monetary credits, a quantity of non-monetary credits, a quantity of promotional credits, and a quantity of player tracking points.

7. The electronic gaming machine of claim 1, wherein when executed by the processor, the plurality of instructions cause the processor to:

prior to the modification of the average expected payback percentage of the electronic gaming machine for the first period of time:

monitor an average payback percentage of the electronic gaming machine over a third period of time that occurs prior to the first period of time, determine whether the average payback percentage deviates from a target payback percentage, based on a determination that the average payback percentage is below the target payback percentage, remove a lower progressive award reset value from the plurality of different progressive award reset values, and based on a determination that the average payback percentage is above the target payback percentage, remove a higher progressive award reset value from the plurality of different progressive award reset values.

8. A gaming system server comprising:

a processor; and a memory device which stores a plurality of instructions, which when executed by the processor, cause the processor to:

randomly determine a game outcome of a game on a gaming device;

based on the game outcome not being associated with a random progressive award reset value triggering event, reset to a default progressive award reset value and a default progressive award hit value; and based on the game outcome being associated with a random progressive award reset value triggering event, modify an average expected payback percentage of the gaming device for a first period of time independent of any modification of the average expected payback percentage for a second greater period of time by, for a progressive award:

randomly determining a progressive award reset value from a plurality of different progressive award reset values, wherein at least two of the plurality of different progressive award reset values have different probabilities of being randomly determined, and after randomly determining the progressive award reset value and based on that randomly determined progressive award reset value, randomly determining a progressive award hit value from a range of progressive award hit values comprising a maximum progressive award hit value at one end of the range and the randomly determined progressive award reset value at another end of the range, communicate data to the gaming device that causes a display device of the gaming device to display:

the randomly determined progressive award reset value as a current value of the progressive award, and the maximum progressive award hit value, responsive to an occurrence of a progressive award increase event, cause the progressive award to be incremented, and responsive to a progressive award triggering event occurring, cause a currently displayed value of the progressive award to be provided to a player, wherein the progressive award triggering event occurs based on the currently displayed value of the progressive award having a predetermined relationship with the randomly determined progressive award hit value.

9. The gaming system server of claim 8, wherein the progressive award reset value is randomly selected from a weighted table of the plurality of different progressive award reset values.

10. The gaming system server of claim 8, wherein the progressive award reset value is at least equal to a progressive award default reset value and less than the randomly determined progressive award hit value.

11. The gaming system server of claim 8, wherein when executed by the processor, the plurality of instructions cause the processor to:

for another progressive award:

randomly determine another progressive award reset value, and after randomly determining the other progressive award reset value and based on that other randomly determined progressive award reset value, randomly determine another progressive award hit value comprising another maximum progressive award hit value, communicate data to the gaming device that causes the display device of the gaming device to display:

the other randomly determined progressive award reset value as a current value of the other progressive award, and the other maximum progressive award hit value, responsive to the occurrence of the progressive award increase event, cause the other progressive award to be incremented, and responsive to another progressive award triggering event occurring, cause a currently displayed value of the other progressive award to be provided to the player, wherein the other progressive award triggering event occurs based on the currently displayed value of the other progressive award having a predetermined relationship with the other randomly determined progressive award hit value.

12. The gaming system server of claim 11, wherein the other progressive award is associated with a different plurality of progressive award reset values from which the other progressive award reset value is randomly determined from, and a different range of progressive award hit values from which the other progressive award hit value is randomly determined from.

13. The gaming system server of claim 8, wherein the progressive award comprises one of a quantity of monetary credits, a quantity of non-monetary credits, a quantity of promotional credits, and a quantity of player tracking points.

14. The gaming system server of claim 8, wherein when executed by the processor, the plurality of instructions cause the processor to:

prior to the modification of the average expected payback percentage of the gaming device for the first period of time:

monitoring, via the processor, an average payback percentage of the gaming device over a third period of time that occurs prior to the first period of time, determining, via the processor, whether the average payback percentage deviates from a target payback percentage, based on a determination that the average payback percentage is below the target payback percentage, removing, via the processor, a lower progressive award reset value from the plurality of different progressive award reset values, and based on a determination that the average payback percentage is above the target payback percentage, removing, via the processor, a higher progressive award reset value from the plurality of different progressive award reset values.

* * * * *